US005238803A

United States Patent [19]

Ichijima et al.

[11] Patent Number: 5,238,803

[45] Date of Patent: Aug. 24, 1993

[54] SILVER HALIDE COLOR PHOTOGRAPHIC PHOTOSENSITIVE MATERIAL CONTAINING A YELLOW COUPLER

[75] Inventors: Seiji Ichijima; Naoki Saito; Keiji Mihayashi, all of Kanagawa, Japan

[73] Assignee: Fuji Photo Film Co., Ltd., Kanagawa, Japan

[21] Appl. No.: 789,825

[22] Filed: Nov. 8, 1991

[30] Foreign Application Priority Data

Nov. 20, 1990 [JP] Japan ..... 2-314525

[51] Int. Cl.[5] ..... G03C 7/36

[52] U.S. Cl. ..... 430/556; 430/557; 430/558

[58] Field of Search ..... 430/558, 556, 557

[56] References Cited

U.S. PATENT DOCUMENTS

| | | | |
|---|---|---|---|
| 4,095,984 | 6/1978 | Sueyoshi et al. | 430/558 |
| 4,149,886 | 4/1979 | Tanaka et al. | 430/382 |
| 4,477,563 | 10/1984 | Ichijima et al. | 430/544 |
| 4,579,816 | 4/1986 | Ohlschlager | 430/557 |
| 5,006,452 | 4/1991 | Bucci | 430/544 |

FOREIGN PATENT DOCUMENTS 1204680 9/1970 United Kingdom .

*Primary Examiner*—Lee C. Wright

*Attorney, Agent, or Firm*—Birch, Stewart, Kolasch & Birch

[57] ABSTRACT

The present invention relates to a silver halide color photographic photosensitive material which contains a coupler which can be represented by formula (1):

Formula (1)

wherein X1 and X2 each represent an alkyl group or a heterocyclic group, Y represents an aryl group or a heterocyclic group, and Z represents a group which is eliminated when the coupler which is represented by formula (1) reacts with an oxidized form of a developing agent.

13 Claims, No Drawings

SILVER HALIDE COLOR PHOTOGRAPHIC PHOTOSENSITIVE MATERIAL CONTAINING A YELLOW COUPLER

FIELD OF THE INVENTION

The present invention relates to color photographic photosensitive materials which contain novel yellow image forming photographic couplers. More precisely, the present invention relates to color photographic photosensitive materials which contain photographic couplers which form images which have excellent color reproduction and image fastness.

BACKGROUND OF THE INVENTION

Images are formed in silver halide color photographic photosensitive materials by means of a reaction between the oxidized primary aromatic amine developing agent and couplers during color development after the material has been exposed. With this system, color reproduction is achieved using the subtractive color method, forming yellow, magenta and cyan colored images which have a complementary color relationship for the reproduction of blue, green and red light.

Acylacetanilide type couplers and malondianilide type couplers have long been known as yellow couplers.

The couplers disclosed, for example, in U.S. Pat. Nos. 4,149,886, 4,095,984 and 4,477,563 or British Patent 1,204,680 are known as malondianilide type couplers. However, these couplers give rise to problems in that the image fastness, and especially the damp/hot fastness, is low. Furthermore, the spectral absorption characteristics of the azomethine dyes obtained from these couplers have a tail on the long wavelength side and improvement is desirable from the viewpoint of color reproduction.

SUMMARY OF THE INVENTION

The object of the present invention is to overcome the aforementioned problems. That is to say, the object of the invention is to provide color photographic photosensitive materials which have better image fastness and color reproduction properties by using novel yellow couplers.

The above-mentioned objects have been realized by means of a silver halide color photographic photosensitive material which contains a coupler which can be represented by general formula (1):

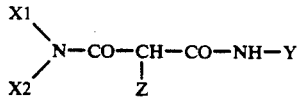

General Formula (1)

wherein X1 and X2 each represent an alkyl group or a heterocyclic group, Y represents an aryl group or a heterocyclic group, and Z represents a group which is eliminated when the coupler which is represented by the general formula reacts with the oxidized form of a developing agent.

DETAILED DESCRIPTION OF THE INVENTION

The couplers which are represented by general formula (1) are described in detail below.

When X1 and X2 represent alkyl groups, they are linear chain, branched or cyclic, saturated or unsaturated, substituted or unsubstituted alkyl groups which have from 1 to 30, and preferably from 1 to 20, carbon atoms. For example, they are methyl, ethyl, propyl, butyl, cyclopropyl, tert-octyl, iso-butyl, dodecyl or 2hexyldecyl groups.

When these alkyl groups have substituent groups the substituent groups may be, for example, halogen atoms (for example fluorine, chlorine), alkoxycarbonyl groups (which have from 2 to 30, and preferably from 2 to 20, carbon atoms, for example methoxycarbonyl, dodecyloxycarbonyl, hexadecyloxycarbonyl), acylamino groups (which have from 2 to 30, and preferably from 2 to 20, carbon atoms, for example acetamido, tetradecanamido, 2-(2,4-di-tert-amylphenoxy)butanamido, benzamido), sulfonamido groups (which have from 1 to 30, and preferably from 1 to 20, carbon atoms, for example methanesulfonamido, dodecanesulfonamido, hexadecylsulfonamido, benzenesulfonamido), carbamoyl groups (which have from 1 to 30, and preferably from 1 to 20, carbon atoms, for example N-butylcarbamoyl, N,N-diethylcarbamoyl, N-mesylcarbamoyl), sulfamoyl groups (which have from 1 to 30, and preferably from 1 to 20, carbon atoms, for example N-butylsulfamoyl, N-dodecylsulfamoyl, N-hexadecylsulfamoyl, N-3-(2,4-di-tert-amylphenoxy)butylsulfamoyl, N,N-diethylsulfamoyl), alkoxy groups (which have from 1 to 30, and preferably from 1 to 20 carbon atoms, for example methoxy, hexadecyloxy, isopropoxy), aryloxy groups (which have from 6 to 20, and preferably from 6 to 10, carbon atoms, for example phenoxy, 4-methoxyphenoxy, 3-tert-butyl-4-hydroxyphenoxy, naphthoxy), aryloxycarbonyl groups (which have from 7 to 21, and preferably from 7 to 11, carbon atoms, for example phenoxycarbonyl), N-acylsulfamoyl groups (which have from 2 to 30, and preferably from 2 to 20, carbon atoms, for example N-propanoylsulfamoyl, N-tetradecanoylsulfamoyl, N-benzoylsulfamoyl), sulfonyl groups (which have from 1 to 30, and preferably from 1 to 20, carbon atoms, for example methanesulfonyl, octanesulfonyl, benzenesulfonyl, dodecanesulfonyl), alkoxycarbonylamino groups (which have from 1 to 30, and preferably from 1 to 20, carbon atoms, for example, ethoxycarbonylamino, tetradecyloxycarbonylamino), cyano group, nitro group, carboxyl group, hydroxyl group, sulfo group, alkylthio groups (which have from 1 to 30, and preferably from 1 to 20, carbon atoms, for example, methylthio, dodecylthio, dodecylcarbamoylmethylthio), ureido groups (which have from 1 to 30, and preferably from 1 to 20, carbon atoms, for example N-phenylureido, N-hexadecylureido), aryl groups (which have from 6 to 20, and preferably from 6 to 10, carbon atoms, for example phenyl, naphthyl, 4-methoxyphenyl), heterocyclic groups (single ring or condensed ring, from three to twelve, and preferably 5 or 6, membered heterocyclic groups which have from 1 to 20, and preferably from 1 to 10, carbon atoms and which contain, for example, at least one nitrogen, oxygen or sulfur atom as a hetero atom, for example, 2-pyridyl, 4-pyridyl, 4-pyrimidinyl, 3-pyrazolyl, 1-pyrrolyl, 2,4-dioxo-1,3-imidazolidin-1-yl, morpholino, indolyl), alkyl groups (linear chain, branched or cyclic, saturated or unsaturated alkyl group which have from 1 to 30, and preferably from 1 to 20, carbon atoms, for example methyl, ethyl, isopropyl, cyclopropyl, tert-pentyl, tert-octyl, cyclopentyl, tert-butyl, sec-butyl, dodecyl, 2-hexyldecyl), acyl groups (which have from 1 to 30, and preferably from 2 to 20, carbon atoms, for example acetyl, benzoyl), acyloxy groups (which have from 2 to 30, and preferably from 2 to 20, carbon atoms, for example propanoyloxy, tetradecanoyloxy), arylthio groups (which have from 6 to 20, and preferably from 6 to 10, carbon atoms, for example phenylthio, naphthylthio), sulfamoylamino groups (which have from 0 to 30, and preferably from 0 to 20, carbon atoms, for example N-butylsulfamoylamino, N-dodecylsulfamoylamino, N-phenylsulfamoylamino) and N-sulfonylsulfamoyl groups (which have from 1 to 30, and preferably from 1 to 20, carbon atoms, for example N-mesylsulfamoyl, N-ethanesulfonylsulfamoyl, N-dodecanesulfonylsulfamoyl, N-hexadecanesulfonylsulfamoyl). The above-mentioned substituent groups may have further substituent groups. The substituent groups cited above can also be cited as examples of these substituent groups.

When X1 and X2 represent substituted alkyl groups, the preferred substituent groups from among the above mentioned substituent groups are the alkoxy groups, halogen atoms, alkoxycarbonyl groups, acyloxy groups, sulfonyl groups, carbamoyl groups, sulfamoyl groups and aryl groups.

When X1 and X2 represent heterocyclic groups they are from three to twelve, and preferably five or six, membered, saturated or unsaturated, substituted or unsubstituted, single ring or condensed ring heterocyclic groups which have from 1 to 20, and preferably from 1 to 10, carbon atoms and which contain at least one nitrogen atom, oxygen atom or sulfur atom, for example, as a hetero atom. Examples of such groups include 3-pyrrolidinyl, 1,2,4-triazol-3-yl, 2-pyridyl, 4-pyrimidinyl, 3-pyrazolyl, 2-pyrrolyl, 2,4-dioxo-1,3-imidazolidin-5-yl and pyranyl.

When the heterocyclic groups have substituent groups, these may be, for example, the same substituent groups cited as substituent groups for the aforementioned alkyl groups. The most desirable substituent groups are such that one of the substituent groups is an alkyl group, an acyl group, an aryl group, a halogen atom, an alkylthio group, an alkoxycarbonyl group, an acylamino group or a carbamoyl group.

When Y in general formula (1) represents an aryl group it is a substituted or unsubstituted aryl group which has from 6 to 20, and preferably from 6 to 10, carbon atoms. For example, it is a group typified by the phenyl group and the naphthyl group. If this group has substituent groups then these are, for example, the same substituent groups cited as examples of substituent groups for the aforementioned alkyl groups. Preferred examples of substituent groups for Y are such that one of the substituent groups is a halogen atom, an alkoxycarbonyl group, a sulfamoyl group, a carbamoyl group, a sulfonyl group, an N-sulfonylsulfamoyl group, an N-acylsulfamoyl group, an alkoxy group, an acylamino group, a sulfonamido group or an alkyl group.

When Y in general formula (1) represents a heterocyclic group it is the same group as those described when X1 or X2 represents a heterocyclic group.

The group represented by Z in general formula (1) may be any of the known coupling leaving groups. Z is preferably a nitrogen containing heterocyclic group which is bonded to the coupling position by a nitrogen atom, an aryloxy group, an arylthio group, a heterocyclic oxy group, a heterocyclic thio group, an acyloxy group, a carbamoyloxy group, an alkylthio group or a halogen atom. These leaving groups may be non-photographically useful groups or photographically useful groups or precursors thereof (for example, development inhibitors, development accelerators, de-silvering accelerators, fogging agents, dyes, film hardening agents, couplers, scavengers for the oxidized form of the developing agent, fluorescent dyes, developing agents or electron transfer agents).

When Z represents a nitrogen containing heterocyclic group which is bonded to the coupling position with a nitrogen atom it is preferably a five or six membered, substituted or unsubstituted, saturated or unsaturated, single ring or condensed ring heterocyclic group which contains from 1 to 15, and preferably from 1 to 10, carbon atoms, and it may contain oxygen atoms or sulfur atoms as well as nitrogen atoms as hetero atoms. 1-Pyrazolyl, 1-imidazolyl, pyrrolino, 1,2,4-triazol-2-yl, 1,2,3-triazol-3-yl, benzotriazole, benzimidazolyl, imidazolidin-2,4-dione-3-yl, oxazolidin-2,4-dione-3-yl, 1,2,4-triazolidin-3,5-dione-4-yl, 2-imidazolinon-2-yl, 3,5-dioxomorpholino and 1-imidazolyl groups can be cited as preferred examples of heterocyclic groups. When these heterocyclic groups have substituent groups, the substituent groups may be, for example, those substituent groups cited as substituent groups permitted for the aforementioned group represented by X1. The preferred substituent groups are such that one of the substituent groups is an alkyl group, an alkoxy group, a halogen atom, an alkoxycarbonyl group, an aryloxycarbonyl group, an alkylthio group, an acylamino group, a sulfonamido group, an aryl group, a nitro group, a carbamoyl group or a sulfonyl group.

When Z represents an aromatic oxy group it is preferably a substituted or unsubstituted aromatic oxy group which has from 6 to 10 carbon atoms. It is most desirably a substituted or unsubstituted phenoxy group. When this group has substituent groups these are, for example, the substituent groups cited as substituent groups which are permissible for the aforementioned group represented by X1. Those cases in which at least one substituent group is an electron withdrawing group are preferred, and the sulfonyl groups, alkoxycarbonyl groups, sulfamoyl groups, halogen atoms, carboxyl group, carbamoyl groups, nitro group and the acyl groups are examples of such groups.

When Z represents an aromatic thio group it is preferably a substituted or unsubstituted aromatic thio group which has from 6 to 10 carbon atoms. Most desirably it is a substituted or unsubstituted phenylthio group. When this group has substituent groups these are, for example, the substituent groups cited as substituent groups which are permissible for the aforementioned group represented by X1. Those cases in which at least one substituent group is an alkyl group, an alkoxy group, a sulfonyl group, an alkoxycarbonyl group, a sulfamoyl group, a halogen atom, a carbamoyl group or a nitro group from among these groups are preferred.

When Z represents a heterocyclic oxy group the heterocyclic part is a three to twelve, and preferably a five or six membered, substituted or unsubstituted, saturated or unsaturated, single ring or condensed ring heterocyclic group which has from 1 to 20, and preferably from 1 to 10 carbon atoms and which includes at least one nitrogen atom, oxygen atom or sulfur atom, for example, as a hetero atom. The pyridyloxy group, the pyrazolyloxy group and the furyloxy group can be cited as examples of heterocyclic oxy groups. When these groups have substituent groups these are, for example, the substituent groups cited as substituent groups which are permissible for the aforementioned group represented by X1. From among these groups the preferred substituent groups are such that at least one substituent group is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group or a sulfonyl group.

When Z represents a heterocyclic thio group the heterocyclic part is a three to twelve, and preferably a five or six, membered, substituted or unsubstituted, saturated or unsaturated, single ring or condensed ring heterocyclic group which has from 1 to 20, and preferably from 1 to 10, carbon atoms and which includes at least one nitrogen atom, oxygen atom or sulfur atom, for example, as a hetero atom. The pyridyloxy group, the tetrazolylthio group, the 1,3,4-thiadiazolylthio group, the 1,3,4-oxadiazolylthio group, the 1,3,4-triazolylthio group, the benzimidazolylthio group, the benzothiazolythio group or the 2-pyridylthio group can be cited as examples of heterocyclic thio groups. When these groups have substituent groups these are, for example, the substituent groups cited as substituent groups which are permissible for the aforementioned group represented by X1. From among these groups the preferred substituent groups are such that at least one substituent group is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, a heterocyclic group or a sulfonyl group.

When Z represents an acyloxy group it is a single ring or condensed ring, substituted or unsubstituted aromatic acyloxy group which preferably has from 6 to 10 carbon atoms, or a substituted or unsubstituted aliphatic acyloxy group which has from 2 to 30, and preferably from 2 to 20, carbon atoms. For example, it is a 2-methylbenzoyloxy group or pivaloyloxy group. When these groups have substituent groups these are, for example, the substituent groups cited as substituent groups which are permissible for the aforementioned group represented by X1.

When Z represents a carbamoyloxy group it is an aliphatic, aromatic, heterocyclic, substituted or unsubstituted carbamoyloxy group which has from 1 to 30, and preferably from 1 to 20, carbon atoms. For example, it is an N,N-diethylcarbamoyloxy group, an N-phenylcarbamoyloxy group, a morpholinocarbonyloxy group, a 1-imidazolylcarbonyloxy group, a 1-pyrrolocarbonyloxy group or a 1-indolinocarbonyloxy group. When these groups have substituent groups they are, for example, the substituent groups cited as substituent groups which are permissible for the aforementioned group represented by X1.

When Z represents an alkylthio group it is a linear chain, branched or cyclic, saturated or unsaturated, substituted or unsubstituted alkylthio group which has from 1 to 30, and preferably from 1 to 20, carbon atoms. When these groups have substituent groups these are, for example, the substituent groups cited as substituent groups which are permissible for the aforementioned group represented by X1.

When Z represents a halogen atom it is preferably a chlorine atom, a bromine atom or a fluorine atom.

The most desirable range of couplers represented by general formula (1) is described below.

The group represented by X1 in general formula (1) is preferably an alkyl group. Most desirably it is an alkyl group which has from 1 to 10 carbon atoms.

The group represented by Y in general formula (1) is preferably an aromatic group. It is most desirably a phenyl group which has at least one substituent group in the ortho position. The description of the substituent groups is the same as that of the substituent groups permitted when the aforementioned Y is an aromatic group. The description of the preferred substituent groups is the same.

The group represented by Z in general formula (1) is preferably a five or six membered nitrogen containing heterocyclic group which is bonded to the coupling position by a nitrogen atom, an aromatic oxy group, a five or six membered heterocyclic oxy group or a five or six membered heterocyclic thio group.

The preferred couplers of general formula (1) can be represented by general formula (2):

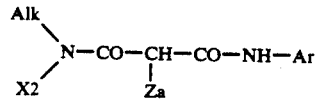

General Formula (2)

wherein X2 has the same meaning as that described in connection with general formula (1), Alk represents an alkyl group which has from 1 to 10 carbon atoms, Ar represents a phenyl group which has at least one substituent group in an ortho position and Za represents a five or six membered nitrogen containing heterocyclic group which is bonded to the coupling position with a nitrogen atom, an aromatic oxy group or a five or six membered heterocyclic thio group.

In general formula (2), the detailed description and preferred ranges of the substituent groups represented by Alk, Ar, X2 and Za are selected from the corresponding ranges in the description given for general formula (1).

The couplers represented by general formulae (1) and (2) may form dimers or larger oligomers (for example tellomers and polymers) which are linked together via divalent groups or groups of higher valency in the groups represented by X1, X2, Y, Z, Alk, Ar and Za. In such a case the number of carbon atoms may be outside the range indicated for each of the aforementioned substituent groups. The coupler represented by general formula (1) or (2) is preferably a coupler of the type which is fast to diffusion. A coupler of this type has within the molecule a group which has a molecular weight which is sufficiently large to render the molecule immobile in the layer to which it has been added. In general, alkyl groups which have a total of 8 to 30, and preferably from 10 to 20, carbon atoms and aryl groups which have substituent groups which have a total of 4 to 20 carbon atoms are used for this purpose. Any of these groups which render the molecule fast to diffusion may be substituted in the molecule and a plurality of such groups may be included.

Actual examples of yellow couplers which can be represented by general formula (1) or (2) are indicated below, but the invention is not limited by these examples.

-continued
Illustrative Compounds
(1)
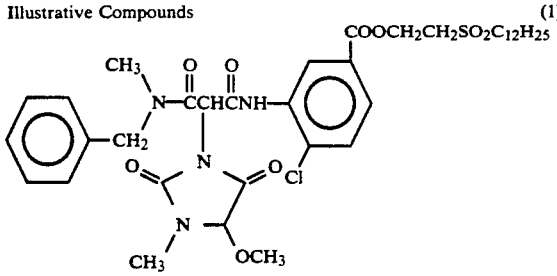
(2)
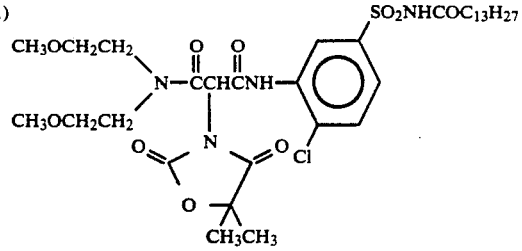
(3)
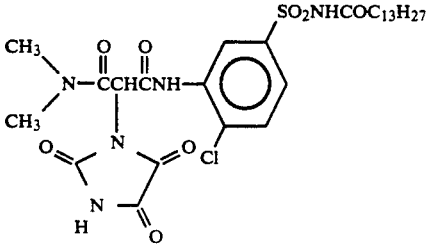
(4)
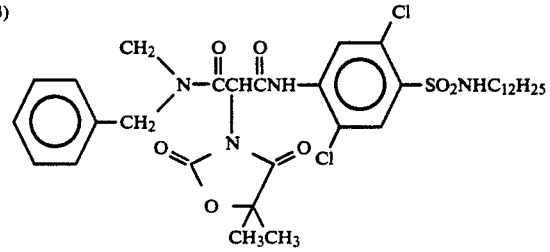
(5)
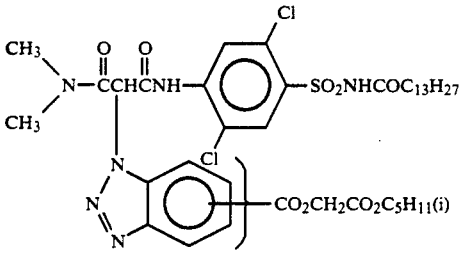
(6)
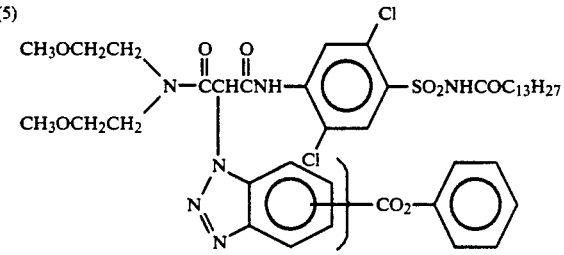
(7)
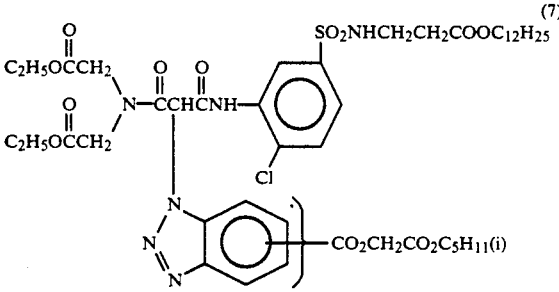
(8)
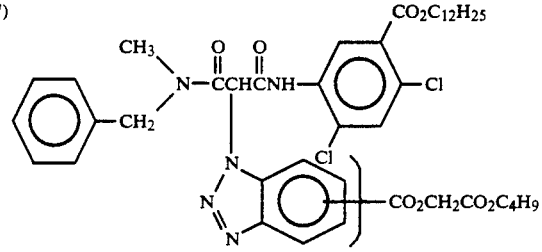
(9)
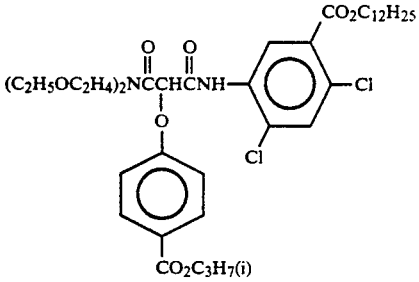
(10)
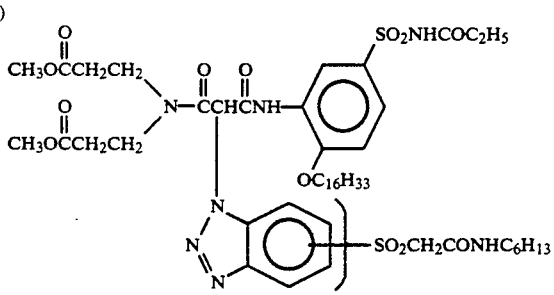
(11)
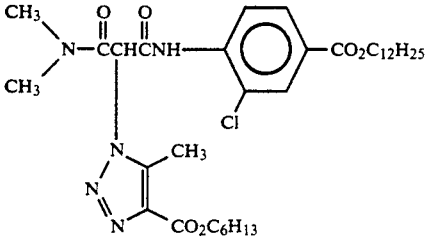
(12)
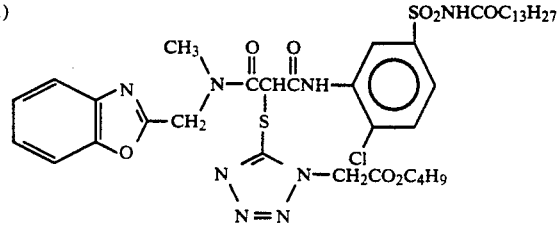

-continued
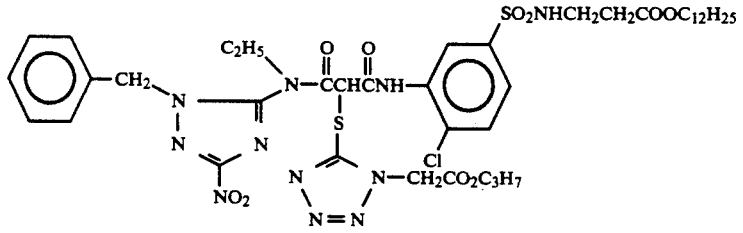
(13)
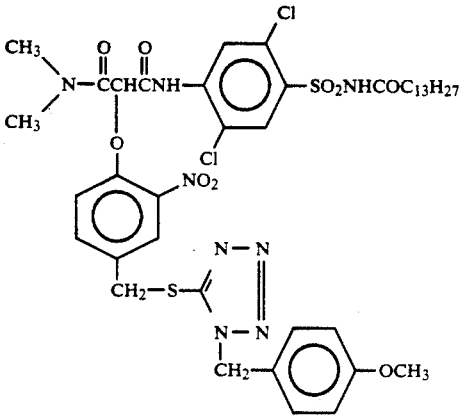
(14)
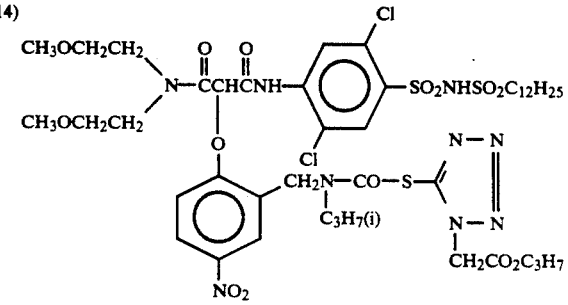
(15)
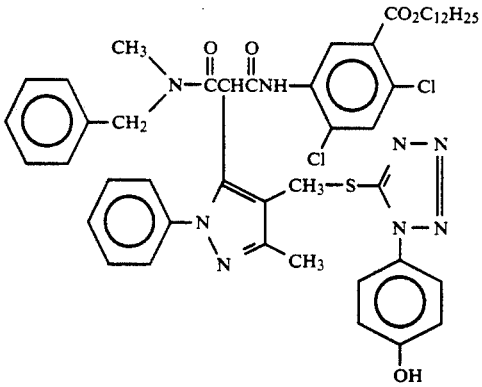
(16)
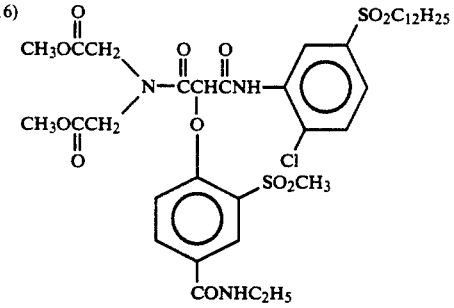
(17)
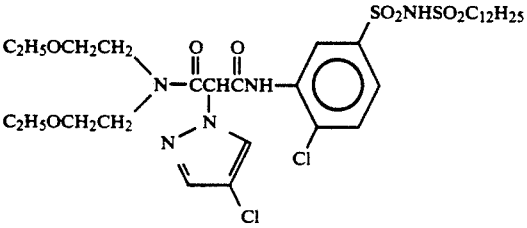
(18)
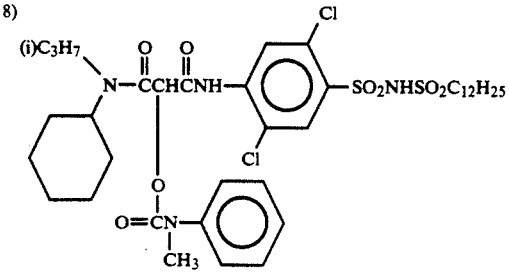
(19)

-continued
(20)
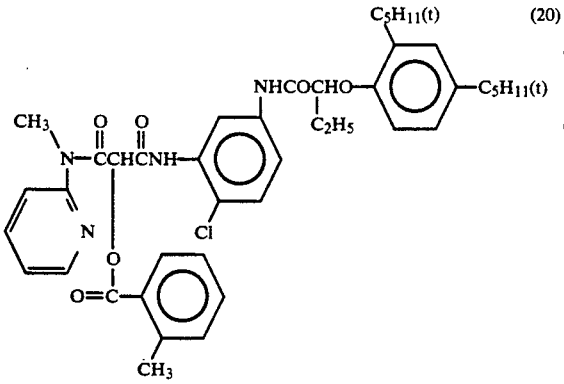
(21)
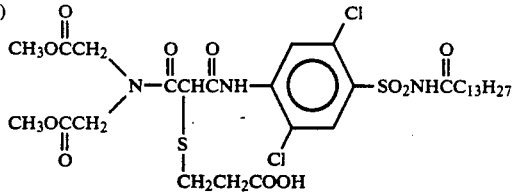
(22)
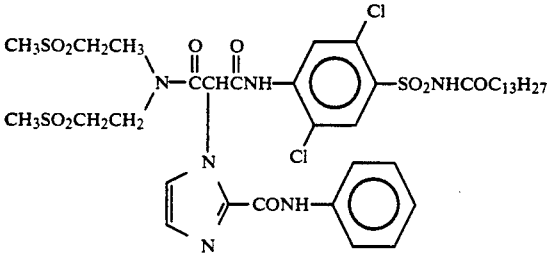
(23)
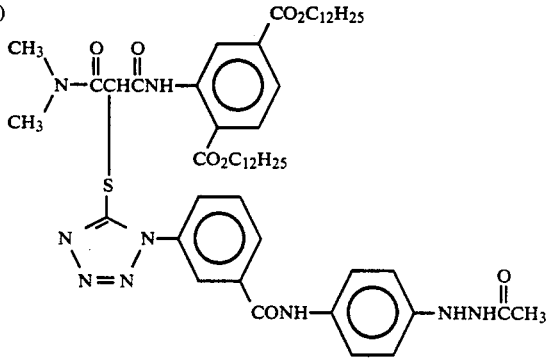
(24)
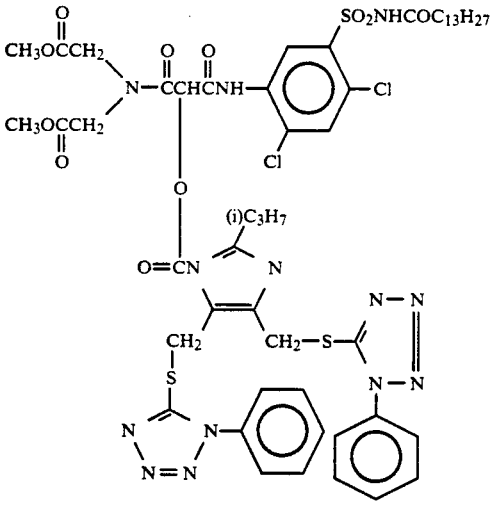
(25)
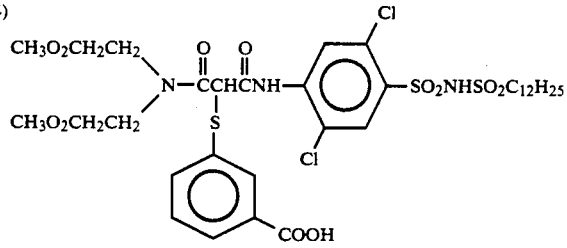
(26)
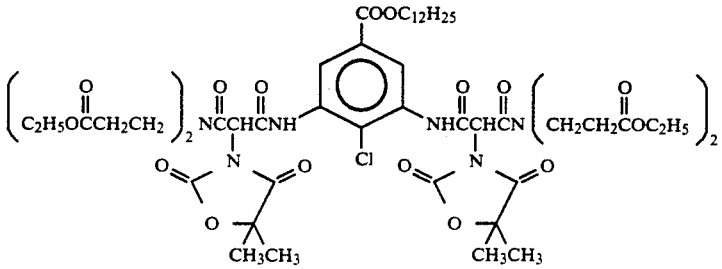

-continued (27)

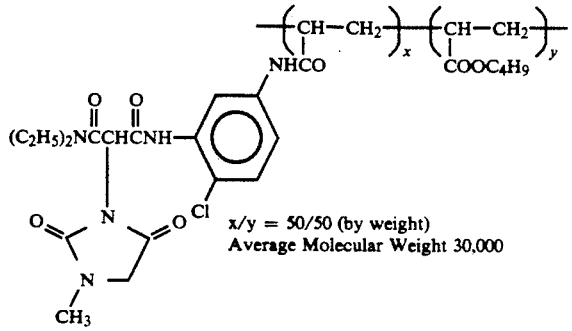

Methods for the preparation of compounds of the present invention are generally known, and methods similar to these known methods can also be employed for the preparation of compounds of the present invention. For example, these compounds can be prepared using the synthetic route indicated below.

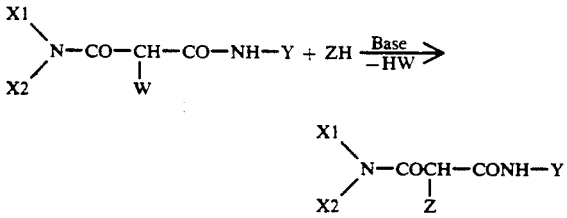

In this equation, X1, X2, Y and Z have the same meaning as described in connection with general formula (1), and W represents a halogen atom (for example, bromine, chlorine). An organic base (for example, triethylamine, diisopropylethylamine, tetramethylguanidine, potassium butoxide) or an inorganic base (for example, sodium hydroxide, potassium hydroxide, sodium hydride, potassium carbonate) is generally used for the base in the above mentioned reaction. Chlorine based solvents (for example dichloromethylene), aromatic based solvents (for example toluene, chlorobenzene), amide based solvents (for example N,N-dimethylformamide, N-methylpyrrolidone) and nitrile based solvents (for example acetonitrile, propionitrile), for example, can be used as reaction solvents.

Example of Synthesis (1)—The Preparation of Illustrative Compound (1)

Compound 1 was prepared using the synthetic route indicated below.

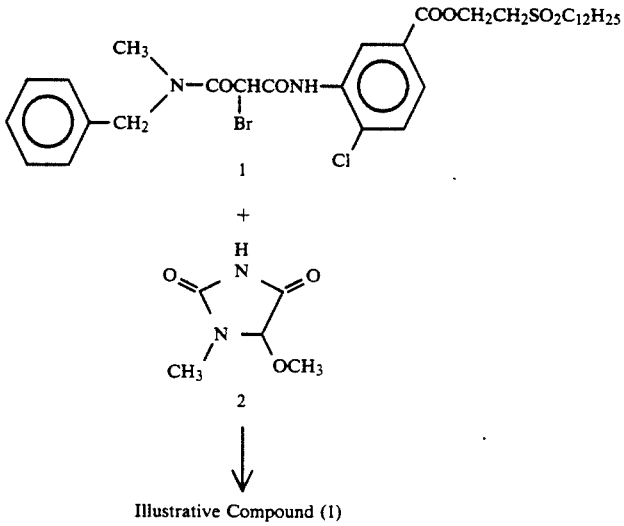

Thus, 35 grams of 1, 15 grams of 2 and 10 grams of triethylamine were mixed in 200 ml of N,N-dimethylformamide and stirred for 2 hours at room temperature. Ethyl acetate (500 ml) was then added and the mixture was transferred to a separating funnel and washed with water. The oil layer was recovered and neutralized with dilute hydrochloric acid, after which it was washed again with water. The oil layer was recovered and the solvent was distilled off under reduced pressure. The residue was separated and refined using column chromatography. Silica gel was used as the adsorbant and ethyl succinate/hexane (1/1) was used as the eluant. The target compound, illustrative compound (1), (21.3 grams) was obtained. This was a glass-like oil.

Example of Synthesis (2)—The Preparation of Illustrative Compound (2)

Compound 2 was prepared using the synthetic route indicated below.

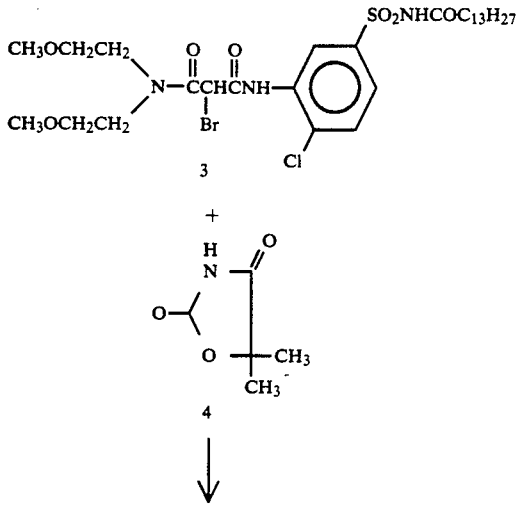

Illustrative Compound (2)

The preparation was carried out in the same way as for the aforementioned illustrative compound (1). However, in this case 35 grams of 3 was used instead of 1 and 12.9 grams of 4 was used instead of 2. The final target material (2) was separated and refined using column chromatography. The waxy material (2) (22.3 grams) was obtained.

Example of Synthesis (3)—The Preparation of Illustrative Compound (5)

Compound 5 was prepared using the synthetic route indicated below.

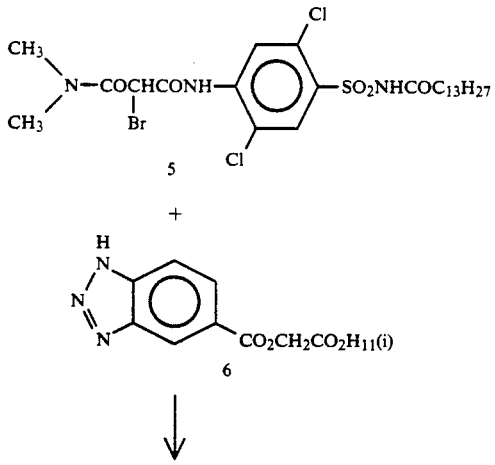

Illustrative Compound (5)

The preparation was carried out in the same way as for the aforementioned illustrative compound (1). However, in this case 32 grams of 5 was used instead of 1 and 29.1 grams of 6 was used instead of 2. The final target material (5) was separated and refined using column chromatography. The waxy material (5) (18.3 grams) was obtained.

Example of Synthesis (4)—The Preparation of Illustrative Compound (6)

Compound 6 was prepared using the synthetic route indicated below.

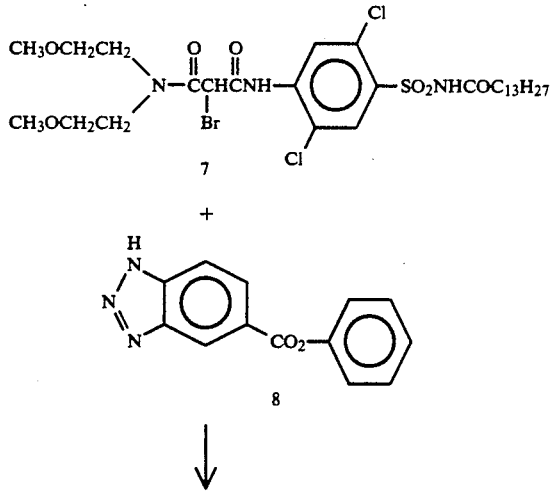

Illustrative Compound (6)

The preparation was carried out in the same way as for the aforementioned illustrative compound (1). However, in this case 36 grams of 7 was used instead of 1 and 23.9 grams of 8 was used instead of 2. The final target material (6) was separated and refined using column chromatography. The waxy material (6) (21.3 grams) was obtained.

The yellow couplers of the present invention are preferably added to a photosensitive silver halide emulsion layer or to a layer adjacent thereto in the photosensitive material, and they are most desirably added to a photosensitive silver halide emulsion layer. The total amount added to the sensitive material is from 0.0001 to 0.80 g/m$^2$, preferably from 0.0005 to 0.50 g/m$^2$, and most desirably from 0.02 to 0.30 g/m$^2$ in cases where a photographically useful component is included in the leaving group Z. In cases where there is no photographically useful group component in the leaving group Z the amount added is from 0.001 to 1.20 g/m$^2$, preferably from 0.01 to 1.00 g/m$^2$, and most desirably from 0.10 to 0.80 g/m$^2$.

The photographically useful group is a development inhibitor residue, a development accelerator residue, a de-silvering accelerator residue, a fogging agent residue, a dye residue, film hardening agent residue, a coupler residue, a scavenger residue for the oxidized form of the developing agent, a fluorescent dye residue, a developing agent residue or an electron transfer agent residue.

The photographically useful groups are disclosed, for example, in U.S. Pat. Nos. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571 and 4,741,994, EP-A-193389, EP-A-348139, and EP-A-272573. Of the photographically useful groups disclosed above, a development inhibitor residue, an electron transfer agent residue, a de-silvering accelerator residue (a bleaching accelerator residue) or a dye residue is preferred.

Yellow couplers of the present invention can be added in the same way as the ordinary couplers as described hereinafter.

A photosensitive material of the present invention should have established, on a support, at least one blue sensitive silver halide emulsion layer, at least one green sensitive silver halide emulsion layer and at least one red sensitive silver halide emulsion layer, but no particular limitation is imposed upon the number or order of the silver halide emulsion layers and non-photosensitive layers. Typically, a silver halide photographic photosensitive material has, on a support, at least one photosensitive layer comprised of a plurality of silver halide emulsion layers which have essentially the same color sensitivity but different photographic speeds, the photosensitive layer being a unit photosensitive layer which is color sensitive to blue light, green light or red light, and in a multi-layer silver halide color photographic material the arrangement of the unit photosensitive layers generally involves their establishment in the order, from the support side, of red sensitive layer, green sensitive layer, blue sensitive layer. However, this order may be reversed, as required, and the layers may be arranged in such a way that a layer which has a different color sensitivity is sandwiched between layers which have the same color sensitivity.

Various non-photosensitive layers, such as intermediate layers for example, may be established between the above-mentioned silver halide photosensitive layers, and as uppermost and lowermost layers.

The intermediate layers may contain couplers and DIR compounds such as those disclosed in the specifications of JP-A-61-43748, JP-A-59-113438, JP-A-59-113440, JP-A-61-20037 and JP-A-61-20038, and they may also contain the generally used anti-color mixing compounds. (The term "JP-A" as used herein signifies an "unexamined published Japanese patent application".)

The plurality of silver halide emulsion layers constituting each unit photosensitive layer is preferably a double layer structure comprised of a high speed emulsion layer and a low speed emulsion layer as disclosed in West German Patent 1,121,470 or British Patent 923,045. Generally, arrangements in which the photographic speed is lower in the layer closer to the support are preferred, and non-photosensitive layers may be established between each of the silver halide emulsion layers. Furthermore, the low speed layers may be arranged on the side furthest away from the support and the high speed layers may be arranged on the side closest to the support as disclosed, for example, in JP-A-57-112751, JP-A-62-200350, JP-A-62-206541 and JP-A-62-206543.

In practical terms, the arrangement may be, from the side furthest from the support, low speed blue sensitive layer (BL)/high speed blue sensitive layer (BH)/high speed green sensitive layer (GH)/low speed green sensitive layer (GL)/high speed red sensitive layer (RH)/low speed red sensitive layer (RL), or BH/BL/GL/GH/RH/RL, or BH/BL/GH/GL/RL/RH.

Furthermore, the layers can be arranged in the order, from the side furthest from the support, of blue sensitive layer/GH/RH/GL/RL as disclosed in JP-B-55-34932. Furthermore, the layers can also be arranged in the order, from the side furthest away from the support, of blue sensitive layer/GL/RL/GH/RH, as disclosed in the specifications of JP-A-56-25738 and JP-A-62-63936.

Furthermore, there are arrangements in which there are three layers which have different speeds with the photosensitivity falling towards the support with the silver halide emulsion layer of the highest photosensitivity at the top, a silver halide emulsion layer which has a lower photosensitivity than the aforementioned layer as an intermediate layer and a silver halide emulsion layer which has a lower photosensitivity than the intermediate layer as a bottom layer, as disclosed in JP-B-49-15495. In the case of structures of this type which have three layers with different photosensitivities, the layers in a layer of the same color sensitivity may be arranged in the order, from the side furthest from the support, of intermediate speed emulsion layer/high speed emulsion layer/low speed emulsion layer, as disclosed in the specification of JP-A-59-202464.

Furthermore, the layers can be arranged in the order high speed emulsion layer/low speed emulsion layer/intermediate speed emulsion layer, or low speed emulsion layer/intermediate speed emulsion layer/high speed emulsion layer, for example.

Furthermore, the arrangement may be varied in the ways indicated above in cases where there are four or more layers.

Arrangements in which donor layers (CL) for a multi-layer effect in which the spectral sensitivity distribution is different from that of the principal photosensitive layers such as the BL, GL, RL, for example, are established adjacent to, or in the proximity of, the principal photosensitive layers, as disclosed in U.S. Pat. Nos. 4,663,271, 4,705,744 and 4,707,436, JP-A-62-160448 and JP-A-63-89850 are desirable.

The various layer structures and arrangements can be selected respectively as described above according to the purpose of the photosensitive material.

The preferred silver halides for inclusion in the photographic emulsion layers of a photographic photosensitive material used in the present invention are silver iodobromides, silver iodochlorides or silver iodochlorobromides which contain not more than about 30 mol% of silver iodide. Most desirably, the silver halide is a silver iodobromide or silver iodochlorobromide which contains from about 2 mol% to about 10 mol% of silver iodide.

The silver halide grains in the photographic emulsion may have a regular crystalline form such as a cubic, octahedral or tetradecahedral form, an irregular crystalline form such as a spherical or plate-like form, a form which has crystal defects such as twinned crystal planes, or a form which is a composite of these forms.

The grain size of the silver halide may be very fine, for example, not more than about 0.2 microns, or large with a projected area diameter of up to about 10 microns. The emulsions may be poly-disperse emulsions or mono-disperse emulsions.

Silver halide photographic emulsions which can be used in the present invention can be prepared, for example, using the methods disclosed in *Research Disclosure* (RD) No. 17643 (December, 1978), pages 22–23, "I. Emulsion Preparation and Types", *Research Disclosure* No. 18716 (November 1979), page 648, and *Research Disclosure*, No. 307105 (November 1989), pages 863–865, by P. Glafkides in *Chimie et Physique Photographique*, published by Paul Montel, 1967, by G F. Duffin in *Photographic Emulsion Chemistry*, published by Focal Press, 1966, and by V.L. Zelikmann et al. in *Making and Coating Photographic Emulsions*, published by Focal Press, 1964.

The mono-disperse emulsions disclosed, for example, in U.S. Pat. Nos. 3,574,628 and 3,655,394, and in British Patent 1,413,748, are also desirable.

Furthermore, tabular grains which have an aspect ratio of at least about 3 can also be used in the present invention. Tabular grains can be prepared easily using the methods described, for example, by Gutoff in *Photographic Science and Engineering*, Volume 14, pages 248–257 (1970), and in U.S. Pat. Nos. 4,434,226, 4,414,310, 4,433,048 and 4,439,520, and British Patent 2,112,157.

The crystal structure may be uniform, or the interior and exterior parts of the grains may have different halogen compositions, or the grains may have a layer-like structure. Moreover, silver halides which have different compositions may be joined with an epitaxial junction or they may be joined with compounds other than silver halides, such as silver thiocyanate or lead oxide, for example. Furthermore, mixtures of grains which have various crystalline forms may be used.

The above mentioned emulsions may be of the surface latent image type in which the latent image is formed principally on the surface, the internal latent image type in which the latent image is formed within the grains, or of a type in which the latent image is formed both at the surface and within the grains, but a negative type emulsion is essential. From among the internal latent image types, the emulsion may be a core/shell internal latent image type emulsion as disclosed in JP-A-63-264740. A method for the preparation of such a core/shell internal latent image type emulsion has been disclosed in JP-A-59-133542. The thickness of the shell of the emulsion differs according to the development processing, for example, but is preferably from 3 to 40 nm, and most desirably from 5 to 20 nm.

The silver halide emulsions generally have been subjected to physical ripening, chemical ripening and spectral sensitization. Additives which are used in such processes have been disclosed in *Research Disclosure* Nos. 17643, 18716 and 307105, and the locations of these disclosures are summarized in the table provided hereinafter.

Two or more different types of emulsion which differ in terms of at least one of the characteristics of grain size, grain size distribution or halogen composition of the photosensitive silver halide emulsion, the grain form or photographic speed can be used in the form of a mixture in the same layer in a photosensitive material of the present invention.

The use of silver halide grains in which the grain surface has been fogged as disclosed in U.S. Pat. No. 4,082,553, silver halide grains in which the grain interior has been fogged as disclosed in U.S. Pat. No. 4,626,498 and JP-A-59-214852 or colloidal silver is desirable in the photosensitive silver halide emulsion layers and/or essentially non-photosensitive hydrophilic colloid layers. Silver halide grains in which the grain interior or surface has been fogged are silver halide grains which can be developed uniformly (not in the form of the image) irrespective of whether they are in an unexposed part or an exposed part of the photosensitive material. Methods for the preparation of silver halide grains in which the interior or surface has been fogged have been disclosed in U.S. Pat. No. 4,626,498 and JP-A-59-214852.

A silver halide which forms the internal nuclei of core/shell type silver halide grains of which the grain interior has been fogged may have the same halogen composition or a different halogen composition. The silver halide of which the grain interior or surface has been fogged may be a silver chloride, a silver chlorobromide, a silver iodobromide or a silver chloroiodobromide. No particular limitation is imposed upon the grain size of these fogged silver halide grains, but an average grain size of 0.01 to 0.75 μm, and especially of 0.05 to 0.6 μm, is preferred. Furthermore, no particular limitation is imposed upon the form of the grains and they may be regular grains, or they may be poly-disperse emulsions, but monodisperse emulsions (in which at least 95% in terms of the weight or number of silver halide grains have a grain size within ±40% of the average grain size) are preferred.

The use of non-photosensitive fine grain silver halides is desirable in the present invention. Non-photosensitive fine grain silver halides are fine grain silver halides which are not photosensitive at the time of the image-wise exposure for obtaining the dye image and which undergo essentially no development during development processing, and those which have not been pre-fogged are preferred.

The fine grain silver halide has a silver bromide content from 0 to 100 mol% and may contain silver chloride and/or silver iodide as required. Those which have a silver iodide content of 0.5 to 10 mol% are preferred.

The fine grain silver halide has an average grain size (the average value of the diameters of the circles corresponding to the projected areas) preferably from 0.01 to 0.5 μm, and most desirably from 0.02 to 0.2 μm.

The fine grain silver halide can be prepared using the same methods as used in general for the preparation of photosensitive silver halides. In this case, the surface of the silver halide grains does not need to be optically sensitized and there is no need for spectral sensitization. However, the pre-addition of known stabilizers such as triazole, azaindene, benzothiazolium or mercapto based compounds or zinc compounds, for example, before addition to the coating liquid is desirable. Colloidal silver can also be desirably included in the layer which contains these fine grain silver halide grains.

The coated weight of silver in a photosensitive material of the present invention is preferably not more than 6.0 g/m$^2$, and most desirably not more than 4.5 g/m$^2$.

Known photographically useful additives which can be used in the present invention have also been disclosed in the three *Research Disclosures* referred to above, and the locations of these disclosures are also indicated in the table below.

| Type of Additive | RD17643 (December 1978) | RD18716 (November 1979) | RD307105 (November 1989) |
|---|---|---|---|
| 1. Chemical Sensitizers | Page 23 | Page 648, right hand column | Page 866 |
| 2. Speed Increasing Agents | | Page 648, right hand column | |
| 3. Spectral Sensitizers, Super-Sensitizers | Pages 23–24 | Page 648 right hand column - page 649 right hand column | Pages 866–868 |
| 4. Bleaching Agents | Page 24 | Page 647, right hand column | Page 868 |
| 5. Anti-foggants, Stabilizers | Pages 24–25 | Page 649, right hand column | Pages 868–870 |
| 6. Light Absorbers, Filter Dyes and Ultraviolet absorbers | Pages 25–26 | Page 649, right hand column - page 650, left hand column | Page 873 |
| 7. Anti-staining Agents | Page 25, right hand column | Page 650, left hand column - right hand column | Page 872 |

-continued

| Type of Additive | RD17643 (December 1978) | RD18716 (November 1979) | RD307105 (November 1989) |
|---|---|---|---|
| 8. Dye Image Stabilizers | Page 25 | page 650, left hand column | Page 872 |
| 9. Film Hardening Agents | Page 26 | Page 651, left hand column | Pages 874–875 |
| 10. Binders | Page 26 | Page 651, left hand column | Pages 873–874 |
| 11. Plasticizers, Lubricants | Page 27 | Page 650, right hand column | Page 876 |
| 12. Coating promotors Surfactants | Pages 26–27 | Page 650, right hand column | Pages 875–876 |
| 13. Anti-static agents | Page 27 | Page 650, right hand column | Pages 876–877 |
| 14. Matting Agents | | | Pages 878–879 |

Furthermore, addition of compounds to the photosensitive material which can react with and fix formaldehyde as disclosed in U.S. Pat. Nos. 4,411,987 and 4,435,503 is desirable for preventing deterioration of photographic performance due to formaldehyde gas.

The inclusion of the mercapto compounds disclosed in U.S. Pat. Nos. 4,740,454 and 4,788,132, JP-A-62-18539 and JP-A-1-283551 is desirable in a photosensitive material of the present invention.

The inclusion of compounds which release fogging agents, development accelerators, silver halide solvents or precursors of these materials irrespective of the amount of developed silver produced by development processing as disclosed in JP-A-1-106052 is desirable in a photosensitive material of the present invention.

The inclusion of the dyes which are dispersed using the methods disclosed in International Patent laid open W088/04794 and JP-A-1-502912, or the dyes disclosed in EP 317,308A, U.S. Pat. No. 4,420,555 and JP-A-1-259358 is desirable in a photosensitive material of the present invention.

Various color couplers can be used in addition to those represented by general formula (1) of the present invention, and actual examples have been disclosed in the patents cited in the aforementioned *Research Disclosure* No. 17643, sections VII-C - G, and *Research Disclosure* No. 307105, sections VII-C - G.

Those yellow couplers disclosed, for example, in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and European Patent 249,473A are preferred. (The term "JP-B" as used herein signifies an "examined Japanese patent publication".)

5-Pyrazolone based compounds and pyrazoloazole based compounds are preferred as magenta couplers, and those disclosed, for example, in U.S. Pat. Nos. 4,310,619 and 4,351,897, European Patent 73,636, U.S. Pat. Nos. 3,061,432 and 3,725,067, *Research Disclosure* No. 24220 (June 1984), JP-A-60-33552, *Research Disclosure* No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630, and International Patent W088/04795 are especially desirable.

Phenol and naphthol based couplers can be cited as cyan couplers, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent laid open 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658 are preferred. Moreover, the pyrazoloazole based couplers disclosed in JP-A-64-553, JP-A-64-554, JP-A-64-555 and JP-A-64-556, and the imidazole based couplers disclosed in U.S. Pat. No. 4,818,672 can also be used.

Typical examples of polymerized dye forming couplers have been disclosed, for example, in U.S. Pat. Nos. 3,451,820, 4,080,211, 4,367,282, 4,409,320 and 4,576,910, British Patent 2,102,137 and European Patent 341,188A.

The couplers disclosed in U.S. Pat. No. 4,366,237, British Patent 2,125,570, European Patent 96,570 and West German Patent (Laid Open) 3,234,533 are preferred as couplers in which the colored dyes have a suitable degree of diffusibility.

The colored couplers for correcting the unwanted absorptions of colored dyes disclosed, for example, in section VII-G of *Research Disclosure* No. 17643, section VII-G of *Research Disclosure* No. 307105, U.S. Pat. No. 4,163,670, JP-B-57-39413, U.S. Pat. Nos. 4,004,929 and 4,138,258, and British Patent 1,146,368 are desirable. Furthermore, the use of couplers which correct the unwanted absorption of colored dyes by means of fluorescent dyes which are released on coupling as disclosed in U.S. Pat. No. 4,774,181, and couplers which have, as leaving groups, dye precursor groups which can form dyes on reaction with the developing agent as disclosed in U.S. Pat. No. 4,777,120 are also desirable.

The use of couplers which release photographically useful residual groups upon coupling is also desirable in the present invention. The DIR couplers which release development inhibitors disclosed in the patents cited in section VII-F of the aforementioned *Research Disclosure* 17643 and section VII-F of *Research Disclosure* No. 307105, JP-A-57-151944, JP-A-57-154234, JP-A-60-184248, JP-A-63-37346, JP-A-63-37350 and U.S. Pat. Nos. 4,248,962 and 4,782,012 are desirable.

The bleaching accelerator releasing couplers disclosed in *Research Disclosure* No. 11449, *Research Disclosure* No. 24241 and JP-A-61-201247 are effective for shortening the time of the processing operation which has a bleaching function, and they are particularly effective in cases where they are added to photosensitive materials in which the aforementioned tabular silver halide grains are used.

The couplers disclosed in British Patents 2,097,140 and 2,131,188, JP-A-59-157638 and JP-A-59-170840 are preferred as couplers which release nucleating agents or development accelerators in the form of the image during development. Furthermore, the compounds which release fogging agents, development accelerators, silver halide solvents etc. by means of a redox reaction with the oxidized form of a developing agent disclosed in JP-A-60-107029, JP-A-60-252340, JP-A-1-44940 and JP-A-1-45687 are also desirable.

Other compounds which can be used in photosensitive materials of the present invention include the competitive couplers disclosed, for example, in U.S. Pat. No. 4,130,427, the multi-equivalent couplers disclosed, for example, in U.S. Pat. Nos. 4,283,472, 4,338,393 and 4,310,618, the DIR redox compound releasing couplers, DIR coupler releasing couplers, DIR coupler releasing redox compounds or DIR redox releasing redox compounds disclosed, for example, in JP-A-60-185950 and JP-A-62-24252, the couplers which release dyes in which the color is restored after elimination disclosed in European Patents 173,302A and 313,308A, the ligand releasing couplers disclosed, for example, in U.S. Pat. No. 4,555,477, the leuco dye releasing couplers disclosed in JP-A-63-75747, and the couplers which release fluorescent dyes disclosed in U.S. Pat. No. 4,774,181.

The couplers used in the present invention can be introduced into the photosensitive material using a variety of known methods.

Examples of high boiling point solvents which can be used in the oil in water dispersion method have been disclosed, for example, in U.S. Pat. No. 2,322,027.

Actual examples of high boiling point organic solvents which have a boiling point of at least 175° C. at normal pressure which can be used in the oil in water dispersion method include phthalic acid esters (for example, dibutyl phthalate, dicyclohexyl phthalate, di-2-ethylhexyl phthalate, decyl phthalate, bis(2,4-ditert-amylphenyl)phthalate, bis(2,4-di-tert-amylphenyl-)isophthalate and bis(1,1-diethylpropyl)phthalate), phosphoric acid or phosphonic acid esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate and di-2-ethylhexyl phenyl phosphonate), benzoic acid esters (for example, 2-ethylhexyl benzoate, dodecyl benzoate, 2-ethylhexyl p-hydroxybenzoate), amides (for example, N,N-diethyldodecanamide, N,N-diethyllaurylamide and N-tetradecylpyrrolidone), alcohols or phenols (for example, iso-stearyl alcohol and 2,4-di-tert-amylphenol), aliphatic carboxylic acid esters (for example, bis(2-ethylhexyl)sebacate, dioctyl azelate, glycerol tributyrate, iso-stearyl lactate and trioctyl citrate), aniline derivatives (for example, N,N-dibutyl-2-butoxy-5-tert-octylaniline) and hydrocarbons (for example, paraffins, dodecylbenzene and diisopropylnaphthalene). Furthermore, organic solvents which have a boiling point above about 30° C., and preferably of at least 50° C., but below about 160° C. can be used as auxiliary solvents, and typical examples of these solvents include ethyl acetate, butyl acetate, ethyl propionate, methyl ethyl ketone, cyclohexanone, 2-ethoxyethyl acetate and dimethylformamide.

The processes and effects of the latex dispersion method and actual examples of latexes for loading purposes have been disclosed, for example, in U.S. Pat. No. 4,199,363, and in West German Patent Applications (OLS) 2,541,274 and 2,541,230.

The addition to the color photosensitive materials of the present invention of various fungicides and biocides such as phenethyl alcohol or 1,2-benzisothiazolin-3-one, n-butyl p-hydroxybenzoate, phenol, 4-chloro-3,5-dimethylphenol, 2-phenoxyethanol and 2-(4-thiazolyl)benzimidazole, for example, as disclosed in JP-A-63-257747, JP-A-62-272248 and JP-A-1-80941 is desirable.

The present invention can be applied to a variety of color photosensitive materials. Typical examples include color negative films for general and cinematographic purposes, color reversal films for slides and television purposes, color papers, color positive films and color reversal papers.

Suitable supports which can be used in the present invention have been disclosed, for example, on page 28 of the aforementioned *Research Disclosure* No. 17643, from the right hand column of page 647 to the left hand column of page 648 of *Research Disclosure* No. 18716, and on page 879 of *Research Disclosure* No. 307105.

The photosensitive materials of the present invention are such that the total film thickness of all the hydrophilic colloid layers on the side where the emulsion layers are located is preferably not more than 28 μm, more desirably not more than 23 μm, even more desirably not more than 18 μm, and most desirably not more than 16 μm. Furthermore, the film swelling rate $T_{\frac{1}{2}}$ is preferably not more than 30 seconds and most desirably not more than 20 seconds. Here, the film thickness signifies the film thickness measured under conditions at 25° C., 55% relative humidity (2 days) and the film swelling rate $T_{\frac{1}{2}}$ is that measured using the methods well known to those in the industry. For example, measurements can be made using a swellometer of the type described by A. Green in *Photogr. Sci. Eng.*, Volume 19, Number 2, pages 124–129. $T_{\frac{1}{2}}$ is defined as the time taken to reach half the saturated film thickness, taking 90% of the maximum swollen film thickness reached on processing the material for 3 minutes, 15 seconds in a color developer at 30° C. as the saturated film thickness.

The film swelling rate $T_{\frac{1}{2}}$ can be adjusted by adding film hardening agents for the gelatin which is used as a binder, or by changing the aging conditions after coating. Furthermore, a swelling factor from 150% to 400% is preferred. The swelling factor can be calculated from the maximum swollen film thickness obtained under the conditions described above using the expression (maximum swollen film thickness minus film thickness)/film thickness.

The establishment of a hydrophilic colloid layer (known as a backing layer) of total dry film thickness from 2 μm to 20 μm on the opposite side from the emulsion layers is desirable in a photosensitive material of the present invention. The inclusion of light absorbing agents, filter dyes, ultraviolet absorbers, anti-static agents, film hardening agents, binders, plasticizers, lubricants, coating promotors and surfactants, for example, as described above, in the backing layer is desirable. The swelling factor of the backing layer is preferably from 150% to 500%.

Color photographic photosensitive materials which are in accordance with the present invention can be developed and processed using the general methods disclosed on pages 28 to 29 of the aforementioned *Research Disclosure* No. 17643, from the left hand column to the right hand column of page 615 of the aforementioned *Research Disclosure* No. 18716, and on pages 880 to 881 of the aforementioned *Research Disclosure* No. 307105.

The color developers used for the development processing of photosensitive materials of the present invention are preferably aqueous alkaline solutions which contain a primary aromatic amine based color developing agent as the principal component. Aminophenol based compounds are also useful, but the use of p-phenylenediamine based compounds as color developing agents is preferred, and typical examples include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, and the sulfate, hydrochloride and p-toluenesulfonate salts of these compounds. From among these compounds, 3-methyl-4-amino-N-ethyl-N-β-hydroxyethylaniline sulfate is especially desirable. Two or more of these compounds can be used conjointly, according to the intended purpose.

The color developer generally contains pH buffers such as alkali metal carbonates, borates or phosphates, and development inhibitors or anti-foggants such as chloride, bromide, iodide, benzimidazoles, benzothiazoles or mercapto compounds. They may also contain, as required, various preservatives such as hydroxylamine, diethylhydroxylamine, sulfite, hydrazines such as N,N-biscarboxymethylhydrazine, phenylsemicarbazides, triethanolamine and catecholsulfonic acids, organic solvents such as ethylene glycol and diethylene glycol, development accelerators such as benzyl alcohol, polyethylene glycol, quaternary ammonium salts and amines, dye forming couplers, competitive couplers, auxiliary developing agents such as 1-phenyl-3-pyrazolidone, thickeners and various chelating agents as typified by the aminopolycarboxylic acids, aminopolyphosphonic acids, alkylphosphonic acids and phosphonocarboxylic acids, typical examples of which include ethylenediamine tetra-acetic acid, nitrilotriacetic acid, diethylenetriamine penta-acetic acid, cyclohexanediamine tetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts of these acids.

Furthermore, color development is carried out after a normal black and white development in the case of reversal processing. Known black and white developing agents including dihydroxybenzenes such as hydroquinone, 3-pyrazolidones such as 1-phenyl-3-pyrazolidone, and aminophenols such as N-methyl-p-aminophenol, for example, can be used individually, or in combinations, in the black and white developer.

The pH of these color developers and black and white developers is generally from 9 to 12. Furthermore, the replenishment rate for these developers depends on the color photographic photosensitive material which is being processed but, in general, it is not more than 3 liters per square meter of photosensitive material, and it can be set to not more than 500 ml by reducing the bromide ion concentration in the replenisher. In those cases where the replenishment rate is low it is desirable that evaporation and aerial oxidation of the liquid should be prevented by minimizing the area of contact with the air in the processing tank.

The contact area between the air and the photographic processing bath in a processing tank can be represented by the open factor which is defined below. Thus:

$$\text{Open Factor} = \frac{\text{Processing bath and Air Contact Area (cm}^2\text{)}}{\text{Processing Bath Volume (cm}^3\text{)}}$$

The above mentioned open factor is preferably not more than 0.1, and most desirably from 0.001 to 0.05. As well as the establishment of a shielding material such as a floating lid, for example, on the surface of the photographic processing bath in the processing tank, the method involving the use of a movable lid as disclosed in JP-A-1-82033 and the method involving the slit development processing disclosed in JP-A-63-216050 can be used as means of reducing the open factor. Reduction of the open factor is preferably applied not only to the processes of color development and black and white development but also to all the subsequent processes, such as the bleaching, bleach-fixing, fixing, water washing and stabilizing processes. Furthermore, the replenishment rate can be reduced by using means of suppressing the accumulation of bromide ion in the development bath.

The color development processing time is generally set between 2 and 5 minutes, but shorter processing times can be devised by increasing the pH or by increasing the concentration of the color developing agent.

The photographic emulsion layer is generally subjected to a bleaching process after color development. The bleaching process may be carried out at the same time as a fixing process (in a bleach-fix process) or it may be carried out separately. Moreover, a bleach-fix process can be carried out after a bleaching process in order to speed up processing. Also, processing can be carried out in two connected bleach-fix baths, a fixing process can be carried out before a bleach-fixing process or a bleaching process can be carried out after a bleach-fix process, as required. Compounds of multivalent metals, such as iron(III) for example, peracids, quinones and nitro compounds can be used as bleaching agents. Typical bleaching agents include organic complex salts of iron(III), for example, complex salts with aminopolycarboxylic acids such as ethylenediamine tetra-acetic acid, diethylenetriamine pentaacetic acid, cyclohexanediamine tetra-acetic acid, methylimino diacetic acid, 1,3-diaminopropane tetraacetic acid and glycol ether diamine tetra-acetic acid, or citric acid, tartaric acid or malic acid. From among these materials, the use of aminopolycarboxylic acid iron(III) complex salts, and principally the use of ethylenediamine tetraacetic acid iron(III) complex salts and 1,3-diaminopropane tetra-acetic acid iron(III) salts, is preferred from the point of view of both rapid processing and the prevention of environmental pollution. Moreover, the aminopolycarboxylic acid iron(III) complex salts are especially useful in both bleach baths and bleach-fix baths. The pH value of the bleach baths and bleach-fix baths in which these aminopolycarboxylic acid iron(III) salts are used is generally from 4.0 to 8, but lower pH values can be used in order to speed up processing.

Bleaching accelerators can be used, as required, in the bleach baths, bleach-fix baths or bleach or bleach-fix pre-baths. Actual examples of useful bleach accelerators have been disclosed in the following publications and these include compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure* No. 17129 (July 1978); the thiazolidine derivatives disclosed in JP-A-50-140129; the thiourea derivatives disclosed in JP-B-45-8506, JP-A-52-20832, JP-A-53-32735 and U.S. Pat. No. 3,706,561, the iodides disclosed in West German Patent 1,127,715 and JP-A-58-16235; the polyoxyethylene compounds disclosed in West German Patents 966,410 and 2,748,430; the polyamine compounds disclosed in JP-B-45-836; other compounds disclosed in JP-A-49-40943, JP-A-49-59644, JP-A-53-94927, JP-A-54-35727, JP-A-55-26506 and JP-A-58-163940; and the bromide ion. From among these compounds, those which have a mercapto group or a disulfide group are preferred in view of their large accelerating effect, and the compounds disclosed in U.S. Pat. No. 3,893,858, West German Patent 1,290,812 and JP-A-53-95630 are especially desirable. Moreover, the compounds disclosed in U.S. Pat. No. 4,552,834 are also desirable. These bleaching accelerators may be added to the sensitive material. These bleaching accelerators are especially effective when bleach-fixing camera color photosensitive materials.

The inclusion of organic acids as well as the compounds indicated above in the bleach baths and bleach-fix baths is desirable for preventing the occurrence of bleach staining. Compounds which have an acid dissociation constant (pKa) from 2 to 5 are especially desirable for the organic acids, and in practice acetic acid, propionic acid and hydroxyacetic acid, for example, are preferred.

Thiosulfate, thiocyanate, thioether based compounds, thioureas and large amounts of iodide can be used, for example, as the fixing agent which is used in a fixing bath or bleach-fixing bath, but thiosulfate is generally used, and ammonium thiosulfate in particular can be used in the widest range of applications. Furthermore, the combined use of thiosulfate and thiocyanate, thioether compounds, thiourea etc. is also desirable. Sulfite, bisulfite, carbonyl/bisulfite addition compounds or the sulfinic acid compounds disclosed in European Patent 294,769A are preferred as preservatives for fixing baths and bleach-fix baths. Moreover, the addition of various aminopolycarboxylic acids and organophosphonic acids to the fixing baths and bleach-fixing baths is desirable for stabilizing these baths.

The addition of compounds having a pKa from 6.0 to 9.0, and preferably imidazoles such as imidazole, 1-methylimidazole, 1-ethylimidazole and 2-methylimidazole in amounts from 0.1 to 10 mol/liter to the fixing bath or bleach-fixing bath is desirable in the present invention.

A short total de-silvering processing time within the range where de-silvering failure does not occur is preferred. The de-silvering time is preferably from 1 to 3 minutes, and most desirably from 1 to 2 minutes. Furthermore, the processing temperature is from 25° C. to 50° C., and preferably from 35° C. to 45° C. The de-silvering rate is improved and the occurrence of staining after processing is effectively prevented within the preferred temperature range.

Agitation as strongly as possible during the desilvering process is desirable. Actual examples of methods of strong agitation include the methods in which a jet of processing liquid is made to impinge on the emulsion surface of the photosensitive material as disclosed in JP-A-62-183460, the method in which the agitation effect is increased using a rotary device as disclosed in JP-A-62-183461, the method in which the photosensitive material is moved with a wiper blade which is established in the bath in contact with the emulsion surface and the agitation effect is increased by the generation of turbulence at the emulsion surface, and the method in which the circulating flow rate of the processing bath as a whole is increased. These means of increasing agitation are effective in bleach baths, bleach-fix baths and fixing baths. It is thought that increased agitation increases the rate of supply of bleaching agent and fixing agent to the emulsion film and consequently increases the de-silvering rate. Furthermore, the aforementioned means of increasing agitation are more effective in cases where a bleaching accelerator is being used, and they sometimes provide a marked increase in the accelerating effect and eliminate the fixer inhibiting action of the bleaching accelerator.

The automatic processors which are used for photosensitive materials of the present invention preferably have photosensitive material transporting devices as disclosed in JP-A-60-191257, JP-A-60-191258 or JP-A-60-191259. With such a transporting device, such as that disclosed in the aforementioned JP-A-60-91257, the carry-over of processing liquid from one bath to the next is greatly reduced and this is very effective for preventing deterioration in processing bath performance. These effects are especially effective for shortening the processing time in each process and for reducing the replenishment rate of each processing bath.

The silver halide color photographic photosensitive materials of this invention are generally subjected to a water washing process and/or stabilizing process after the desilvering process. The amount of wash water used in the washing process can be fixed within a wide range, depending on the application and the nature (depending on the materials such as couplers which have been used, for example) of the photosensitive material, the wash water temperature, the number of water washing tanks (the number of water washing stages) and the replenishment system, i.e. whether a counter flow or a sequential flow system is used, and various other conditions. The relationship between the amount of water used and the number of washing tanks in a multistage counter-flow system can be obtained using the method outlined on pages 248–253 of the *Journal of the Society of Motion Picture and Television Engineers*, Volume 64 (May 1955).

The amount of wash water used can be greatly reduced by using the multi-stage counter-flow system noted in the aforementioned literature, but bacteria proliferate due to the increased residence time of the water in the tanks and problems arise with the suspended matter which is produced and becomes attached to the photosensitive material. The method in which the calcium ion and magnesium ion concentrations are reduced, disclosed in JP-A-62-288838, is very effective as a means of overcoming this problem when processing color photosensitive materials of the present invention. Furthermore, the isothiazolone compounds and thiabendazoles disclosed in JP-A-57-8542, the chlorine based disinfectants such as chlorinated sodium isocyanurate, and benzotriazole, for example, and the disinfectants disclosed in *The Chemistry of Biocides and Fungicides* by Horiguchi, (1986, Sanko Shuppan), in *Killing Microorganisms, Biocidal and Funqicidal Techniques* (1982) published by the Health and Hygiene Technology Society, and in *A Dictionary of Biocides and Fungicides* (1986) published by the Japanese Biocide and Fungicide Society, can also be used in this connection.

The pH value of the washing water when processing photosensitive materials of the present invention is from 4 to 9, and preferably from 5 to 8. The washing water temperature and the washing time can be set variously in accordance with the nature and application of the photosensitive material but, in general, washing conditions from 20 seconds to 10 minutes at a temperature from 15° C. to 45° C., and preferably from 30 seconds to 5 minutes at a temperature from 25° C. to 40° C., are selected. Moreover, the photosensitive materials of this invention can be processed directly in a stabilizing bath instead of being subjected to a water wash as described above. The known methods disclosed in JP-A-57-8543, JP-A-58-14834 and JP-A-60-220345 can be used for a stabilization process of this type.

Furthermore, there are also cases in which a stabilization process is carried out following the aforementioned water washing process, and the stabilizing baths which contain dye stabilizing agents and surfactants which are used as final baths with camera color photosensitive materials are an example of such a process. Aldehydes such as formalin and glutaraldehyde, N-methylol compounds, hexamethylenetetramine and aldehyde/bisulfite addition compounds can be used, for example, as dye stabilizing agents.

Various chelating agents and fungicides can also be added to these stabilizing baths.

The overflow which accompanies replenishment of the above-mentioned water washing or stabilizing baths can be reused in other processes, such as the desilvering process, for example.

Concentration correction with the addition of water is desirable in cases where the above-mentioned processing baths become concentrated due to evaporation when processing in an automatic processor, for example.

Color developing agents can be incorporated into a silver halide color photosensitive material of the present invention with a view to simplifying and speeding up processing. The incorporation of various color developing agent precursors is preferred. For example, the indoaniline based compounds disclosed in U.S. Pat. No. 3,342,597, the Shiff's base type compounds disclosed in U.S. Pat. No. 3,342,599, *Research Disclosure* No. 14850 and *Research Disclosure* No. 15159, the aldol compounds disclosed in *Research Disclosure* No. 13924, the metal complex salts disclosed in U.S. Pat. No. 3,719,492 and the urethane based compounds disclosed in JP-A-53-135628 can be used for this purpose.

Various 1-phenyl-3-pyrazolidones may be incorporated, as required, into a silver halide color photosensitive material of the present invention in order to accelerate color development. Typical compounds have been disclosed, for example, in JP-A-56-64339, JP-A-57-144547 and JP-A-58-115438.

The various processing baths in the present invention are used at a temperature from 10° C. to 50° C. The standard temperature is generally from 33° C. to 38° C., but accelerated processing and shorter processing times can be realized at higher temperatures while, on the other hand, increased picture quality and better processing bath stability can be achieved at lower temperatures.

Furthermore, the silver halide photosensitive materials of the present invention can also be used in the heat developable photosensitive materials disclosed, for example, in U.S. Pat. No. 4,500,626, JP-A-60-133449, JP-A-59-218443, JP-A-61-238056 and European Patent 210,660A2.

ILLUSTRATIVE EXAMPLES

The invention is described in detail below by means of illustrative examples, but the invention is not limited by these examples.

EXAMPLE 1

Photosensitive material 101 was prepared by coating each of the layers in which the compositions are indicated below on a triacetylcellulose film support on which an underlayer had been established.

| | |
|---|---|
| (1) Emulsion Layer | |
| Tabular Emulsion (10 mol % silver iodide, average aspect ratio 7.5, average grain diameter 0.65 μm) | 1.70 g/m² as silver |
| Comparative Coupler C-1 | 0.82 g/m² |
| Tricresyl phosphate | 0.80 g/m² |
| Gelatin | 3.50 g/m² |
| (2) Protective Layer | |
| 2,4-Dichloro-6-hydroxy-s-triazine, sodium salt | 0.15 g/m² |
| Gelatin | 1.8 g/m² |

Samples 102–108

Samples 102 to 108 were prepared by replacing the comparative coupler (C-1) which was added to the emulsion layer of sample 101 with equimolar amounts of the couplers shown in Table 1.

These samples were subjected to a white light exposure for sensitometric purposes and then they were color developed and processed as indicated below. The yellow densities of the developed samples were measured and the relative speeds indicated by the logarithm of the reciprocal of the exposure required to provide a density of (fog+0.2) and the maximum color densities were obtained. Furthermore, the spectral absorbances of the yellow dyes were measured at the maximum color density and the peak wavelength and the ratios of the absorbance ($D_{520\,nm}$) at 520 nm and the absorbance at the peak wavelength ($D_{\lambda max}$) were obtained. The results are shown in Table 1.

Furthermore, after these measurements had been made the samples were stored for 10 days under conditions at 60° C., 70% relative humidity. The densities were measured again and the fall in density at the maximum color density was obtained in each case.

The development processing operations used here were carried out at 38° C. under the following conditions.

| | |
|---|---|
| 1. Color Development | 2 minutes 45 seconds |
| 2. Bleaching | 6 minutes 30 seconds |
| 3. Water Washing | 3 minutes 15 seconds |
| 4. Fixing | 6 minutes 30 seconds |
| 5. Water Washing | 3 minutes 15 seconds |
| 6. Stabilization | 3 minutes 15 seconds |

The compositions of the processing baths used in each process were as indicated below.

| | |
|---|---|
| Color Developer | |
| Nitrilo tri-acetic acid, sodium salt | 1.0 gram |
| Sodium sulfite | 4.0 grams |
| Sodium carbonate | 30.0 grams |
| Potassium bromide | 1.4 grams |
| Hydroxylamine sulfate | 2.4 grams |
| 4-(N-Ethyl-N-β-hydroxyethylamino)-2-methylaniline sulfate | 4.5 grams |
| Water to make | 1 liter |
| Bleach | |
| Ammonium bromide | 160.0 grams |
| Aqueous ammonia (28%) | 25.0 ml |
| Ethylene diamine tetra-acetic acid, sodium iron salt | 130 grams |
| Glacial acetic acid | 14 ml |
| Water to make | 1 liter |
| Fixer | |
| Sodium tetrapolyphosphate | 2.0 grams |
| Sodium sulfite | 4.0 grams |
| Ammonium thiosulfate (70%) | 175.0 ml |

-continued

| | |
|---|---|
| Sodium bisulfite | 4.6 grams |
| Water to make | 1 liter |
| Stabilizer | |
| Formalin | 2.0 ml |
| Water to make | 1 liter |

-continued

| | |
|---|---|
| Potassium thiocyanate | 1.2 grams |
| Potassium iodide (0.1% solution) | 2 ml |
| Water to make | 1000 ml |
| Reversal Bath | |
| Water | 700 ml |
| Nitrilo-N,N,N-trimethylenephosphonic acid, penta-sodium salt | 3 grams |

TABLE 1

| Sample | Coupler | Relative Speed | Maximum Color Density | Peak Absorption Wavelength (nm) | $D_{520\ nm}/D_{\lambda max}$ (%) | Colored Image Storage Properties (Fall in Density) |
|---|---|---|---|---|---|---|
| 101 (Comparative Example) | C-1 | 0.00 | 2.58 | 451 | 14.9 | 0.16 |
| 102 (Comparative Example) | C-2 | −0.04 | 2.17 | 448 | 12.4 | 0.04 |
| 103 (Comparative Example) | C-3 | −0.06 | 2.09 | 449 | 12.6 | 0.02 |
| 104 (Comparative Example) | C-4 | −0.06 | 2.07 | 449 | 12.8 | 0.02 |
| 105 (Comparative Example) | C-5 | 0.01 | 2.39 | 446 | 18.5 | 1.62 |
| 106 (This Invention) | (1) | 0.02 | 2.73 | 453 | 11.5 | 0.02 |
| 107 (This Invention) | (2) | 0.01 | 2.69 | 452 | 10.9 | 0.02 |
| 108 (This Invention) | (4) | 0.04 | 2.73 | 453 | 11.0 | 0.02 |

It is clear from Table 1 that the samples in which couplers of the present invention had been used had high photographic speeds and high maximum color densities, a low absorbance ratio at 520 nm which is the long wave part of the yellow dye (gold-orange color) and excellent storage properties.

EXAMPLE 2

Samples 201 to 208 were prepared by replacing the tabular emulsion of samples 101 to 108 with a tetradecahedral emulsion (4 mol% silver iodide, average grain size 0.40 μm, variation coefficient of the grain size 0.12), and setting the coated silver weight to 1.00 g/m$^2$.

These samples were subjected to a white light exposure for sensitometric purposes and color developed and processed in the way indicated below.

The yellow densities of the processed samples were measured and the results were as shown in Table 2.

Furthermore, the samples were stored for 7 days under conditions of 80° C., 50% relative humidity after measuring the densities and the loss in colored image density was obtained.

| Processing Operations | | |
|---|---|---|
| Process | Time | Temperature |
| First Development | 6 minutes | 38° C. |
| Water Wash | 2 minutes | 38° C. |
| Reversal | 2 minutes | 38° C. |
| Color Development | 6 minutes | 38° C. |
| Conditioning | 2 minutes | 38° C. |
| Bleaching | 6 minutes | 38° C. |
| Fixing | 4 minutes | 38° C. |
| Water Wash | 4 minutes | 38° C. |
| Stabilization | 1 minute | Normal Temperature |
| Drying | 4 minutes | 50° C. |

The composition of each processing bath was as indicated below.

| | |
|---|---|
| First Developer | |
| Water | 700 ml |
| Nitrilo-N,N,N-trimethylenephosphonic acid, penta-sodium salt | 2 grams |
| Sodium sulfite | 20 grams |
| Hydroquinone mono-sulfonate | 30 grams |
| Sodium carbonate (mono-hydrate) | 30 grams |
| 1-Phenyl-4-methyl-4-hydroxymethyl-3-pyrazolidone | 2 grams |
| Potassium bromide | 2.5 grams |
| Stannous chloride (di-hydrate) | 1 gram |
| p-Aminophenol | 0.1 gram |
| Sodium hydroxide | 8 grams |
| Glacial acetic acid | 15 ml |
| Water to make | 1000 ml |
| Color Developer | |
| Water | 700 ml |
| Nitrilo-N,N,N-trimethylenephosphonic acid, penta-sodium salt | 3 grams |
| Sodium sulfite | 7 grams |
| Sodium triphosphate (dodeca-hydrate) | 36 grams |
| Potassium bromide | 1 gram |
| Potassium iodide (0.1% solution) | 90 ml |
| Sodium hydroxide | 3 grams |
| Citrazinic acid | 1.5 grams |
| N-Ethyl-N-(β-methanesulfonamidoethyl)-3-methyl-4-aminoaniline sulfate | 11 grams |
| 3,6-Dithioctane-1,8-diol | 1 gram |
| Water to make | 1000 ml |
| Conditioner | |
| Water | 700 ml |
| Sodium sulfite | 12 grams |
| Ethylenediamine tetra-acetic acid, sodium salt, di-hydrate | 8 grams |
| Thioglycerine | 0.4 ml |
| Glacial acetic acid | 3 ml |
| Water to make | 1000 ml |
| Bleach | |
| Water | 800 ml |
| Ethylenediamine tetra-acetic acid, sodium salt, di-hydrate | 2 grams |
| Ethylenediamine tetra-acetic acid, iron (III) ammonium salt, di-hydrate | 120 grams |
| Potassium bromide | 100 grams |
| Water to make | 1000 ml |
| Fixer | |
| Water | 800 ml |
| Sodium thiosulfate | 80.0 grams |
| Sodium sulfite | 5.0 grams |
| Sodium bisulfite | 5.0 grams |
| Water to make | 1000 ml |
| Stabilizer | |
| Water | 800 ml |
| Formalin (37 wt %) | 5.0 ml |
| Fuji Driwell (a surfactant made by the Fuji Photo Film Co., Ltd.) | 5.0 ml |
| Water to make | 1000 ml |

TABLE 2

| Sample | Coupler | Maximum Color Density | Image Storage Properties (Fall in Density) |
|---|---|---|---|
| 201 (Comp. Ex.) | C-1 | 2.18 | 0.18 |
| 202 (Comp. Ex.) | C-2 | 1.85 | 0.05 |
| 203 (Comp. Ex.) | C-3 | 1.78 | 0.03 |

TABLE 2-continued

| Sample | Coupler | Maximum Color Density | Image Storage Properties (Fall in Density) |
|---|---|---|---|
| 204 (Comp. Ex.) | C-4 | 1.76 | 0.03 |
| 205 (Comp. Ex.) | C-5 | 2.04 | 1.40 |
| 206 (Invention) | (1) | 2.36 | 0.02 |
| 207 (Invention) | (2) | 2.31 | 0.02 |
| 208 (Invention) | (4) | 2.33 | 0.02 |

It is clear Table 2 that the samples of the present invention had a high color density and excellent color image storage properties.

EXAMPLE 3

Samples 301 to 308 were prepared by replacing the tabular emulsion used in samples 101 to 108 with a cubic emulsion (silver chlorobromide, 1 mol% silver bromide, average grain size 0.25 μm, variation coefficient of the grain size 0.11) and providing a coated silver weight of 0.50 g/m$^2$, a coated weight of tricresyl phosphate of 0.80 g/m$^2$ and a coated weight of dibutyl phthalate of 0.50 g/m$^2$.

These samples were subjected to a white light exposure for sensitometric purposes and then processed using the color development processing operations indicated below, and the relative speeds and the maximum color densities were measured.

| Process | Temperature | Time |
|---|---|---|
| Color Development | 38° C. | 35 seconds |
| Bleach-fix | 35° C. | 45 seconds |
| Rinse (1) | 35° C. | 30 seconds |
| Rinse (2) | 35° C. | 30 seconds |
| Rinse (3) | 35° C. | 30 seconds |
| Drying | 80° C. | 60 seconds |

(A three tank counter-flow system from rinse (3) to rinse (1))

The composition of each processing bath is indicated below.

| | |
|---|---|
| Color Developer | |
| Water | 800 ml |
| Ethylenediamine-N,N,N,N-tetra-methylenephosphonic acid | 3.0 grams |
| Triethanolamine | 8.0 grams |
| Potassium chloride | 3.1 grams |
| Potassium bromide | 0.015 gram |
| Potassium carbonate | 25 grams |
| Hydrazino-diacetic acid | 5.0 grams |
| N-Ethyl-N-(β-methanesulfonamidoethyl)-3-methyl-4-aminoaniline sulfate | 5.0 grams |
| Fluorescent whitener (WHITEX-4, made by Sumitomo Chemicals) | 2.0 grams |
| Water to make | 1000 ml |
| pH (potassium hydroxide added) | 10.05 |
| Bleach-Fixer | |
| Water | 400 ml |
| Ammonium thiosulfate solution (700 g/l) | 100 ml |
| Ammonium sulfite | 45 grams |
| Ethylenediamine tetra-acetic acid, iron (III) ammonium salt | 55 grams |
| Ethylenediamine tetra-acetic acid | 3 grams |
| Ammonium bromide | 30 grams |
| Nitric acid (67%) | 27 grams |
| Water to make | 1000 ml |
| pH | 5.8 |
| Rinse Bath | |
| Ion exchange water (Calcium and magnesium both less than 3 ppm) | |

TABLE 3

| Sample | Coupler | Relative Speed | Maximum Color Density |
|---|---|---|---|
| 301 (Comp. Ex.) | C-1 | 0.00 | 2.31 |
| 302 (Comp. Ex.) | C-2 | −0.02 | 1.92 |
| 303 (Comp. Ex.) | C-3 | −0.04 | 1.87 |
| 304 (Comp. Ex.) | C-4 | −0.03 | 1.89 |
| 305 (Comp. Ex.) | C-5 | 0.00 | 2.22 |
| 306 (Invention) | (1) | 0.02 | 2.56 |
| 307 (Invention) | (2) | 0.01 | 2.49 |
| 308 (Invention) | (4) | 0.03 | 2.54 |

It is clear from Table 3 that the samples of the present invention had a high speed and a high color density.

EXAMPLE 4

Sample 401, a multi-layer color photosensitive material, was prepared by multi-layer coating each of the layers in which the compositions are indicated below on a cellulose triacetate film support on which an underlayer had been established.

Composition of the Photosensitive Layer

The numerical value corresponding to each component indicates the coated weight in units of g/m$^2$, the coated weight being shown as the calculated weight of silver in the case of the silver halides. However, with the sensitizing dyes the coated weight is indicated in units of mol per mol of silver halide in the same layer.

| Sample 401 | | |
|---|---|---|
| First Layer (Anti-halation Layer) | | |
| Black colloidal silver | as silver | 0.18 |
| Gelatin | | 0.90 |
| Second Layer (Intermediate Layer) | | |
| 2,5-Di-tert-pentadecylhydroquinone | | 0.18 |
| EX-1 | | 0.070 |
| EX-3 | | 0.020 |
| EX-12 | | $2.0 \times 10^{-3}$ |
| EX-14 | | 0.015 |
| U-1 | | 0.060 |
| U-2 | | 0.080 |
| U-3 | | 0.10 |
| HBS-1 | | 0.10 |
| HBS-2 | | 0.020 |
| Gelatin | | 0.75 |
| Third Layer (First Red Sensitive Emulsion Layer) | | |
| Emulsion A | as silver | 0.25 |
| Emulsion B | as silver | 0.25 |
| Sensitizing dye I | | $6.9 \times 10^{-5}$ |
| Sensitizing dye II | | $1.8 \times 10^{-5}$ |
| Sensitizing dye III | | $3.1 \times 10^{-4}$ |
| EX-2 | | 0.34 |
| Ex-8 | | 0.035 |
| EX-10 | | 0.020 |
| U-1 | | 0.070 |
| U-2 | | 0.050 |
| U-3 | | 0.070 |
| HBS-1 | | 0.060 |
| Gelatin | | 0.87 |
| Fourth Layer (Second Red Sensitive Emulsion Layer) | | |
| Emulsion G | as silver | 1.00 |
| Sensitizing dye I | | $5.1 \times 10^{-5}$ |
| Sensitizing dye II | | $1.4 \times 10^{-5}$ |
| Sensitizing dye III | | $2.3 \times 10^{-4}$ |
| EX-2 | | 0.40 |
| EX 3 | | 0.050 |
| Ex-8 | | 0.045 |
| EX-10 | | 0.015 |
| U-1 | | 0.070 |
| U-2 | | 0.050 |
| U-3 | | 0.070 |
| Gelatin | | 1.10 |
| Fifth Layer (Third Red Sensitive Emulsion Layer) | | |
| Emulsion D | as silver | 1.60 |

-continued

| Sample 401 | | |
|---|---|---|
| Sensitizing dye I | | $5.4 \times 10^{-5}$ |
| Sensitizing dye II | | $1.4 \times 10^{-5}$ |
| Sensitizing dye III | | $2.4 \times 10^{-4}$ |
| EX-2 | | 0.097 |
| EX-3 | | 0.010 |
| EX-4 | | 0.080 |
| EX-8 | | 0.015 |
| Coupler (C-6) | | 0.030 |
| HBS-1 | | 0.12 |
| HBS-2 | | 0.050 |
| Gelatin | | 1.20 |
| Sixth Layer (Intermediate Layer) | | |
| EX-5 | | 0.032 |
| EX-14 | | 0.010 |
| HBS-1 | | 0.020 |
| Gelatin | | 0.50 |
| Seventh Layer (First Green Sensitive Emulsion Layer) | | |
| Emulsion A | as silver | 0.15 |
| Emulsion B | as silver | 0.15 |
| Sensitizing dye IV | | $3.0 \times 10^{-5}$ |
| Sensitizing dye V | | $1.0 \times 10^{-4}$ |
| Sensitizing dye IV | | $3.8 \times 10^{-4}$ |
| EX-1 | | 0.021 |
| EX-6 | | 0.090 |
| EX-7 | | 0.030 |
| EX-8 | | 0.025 |
| EX-9 | | 0.18 |
| Coupler (C-6) | | 0.040 |
| HBS-1 | | 0.10 |
| HBS-3 | | 0.010 |
| Gelatin | | 0.63 |
| Eighth Layer (Second Green Sensitive Emulsion Layer) | | |
| Emulsion C | as silver | 0.45 |
| Sensitizing dye IV | | $2.1 \times 10^{-5}$ |
| Sensitizing dye V | | $7.0 \times 10^{-5}$ |
| Sensitizing dye VI | | $2.6 \times 10^{-4}$ |
| EX-6 | | 0.035 |
| EX-7 | | 0.026 |
| EX-9 | | 0.060 |
| Coupler (C-6) | | 0.018 |
| HBS-1 | | 0.16 |
| HBS-3 | | $8.0 \times 10^{-3}$ |
| Gelatin | | 0.50 |
| Ninth Layer (Third Green Sensitive Emulsion Layer) | | |
| Emulsion E | as silver | 1.20 |
| Sensitizing dye IV | | $3.5 \times 10^{-5}$ |
| Sensitizing dye V | | $8.0 \times 10^{-5}$ |
| Sensitizing dye VI | | $3.0 \times 10^{-4}$ |
| EX-1 | | 0.025 |
| EX-11 | | 0.10 |
| EX-13 | | 0.015 |
| HBS-1 | | 0.12 |
| HBS-2 | | 0.10 |

-continued

| Sample 401 | | |
|---|---|---|
| Gelatin | | 1.10 |
| Tenth Layer (Yellow Filter Layer) | | |
| Yellow colloidal silver | as silver | 0.050 |
| EX-5 | | 0.065 |
| EX-14 | | 0.020 |
| HBS-1 | | 0.030 |
| Gelatin | | 0.45 |
| Eleventh Layer (First Blue Sensitive Emulsion Layer) | | |
| Emulsion A | as silver | 0.080 |
| Emulsion B | as silver | 0.070 |
| Emulsion F | as silver | 0.070 |
| Sensitizing dye VII | | $3.5 \times 10^{-4}$ |
| Coupler (C-6) | | 0.075 |
| Coupler (C-1) | | 0.72 |
| HBS-1 | | 0.28 |
| Gelatin | | 1.10 |
| Twelfth Layer (Second Blue sensitive Emulsion Layer) | | |
| Emulsion G | as silver | 0.45 |
| Sensitizing dye VII | | $2.1 \times 10^{-4}$ |
| Coupler (C-1) | | 0.15 |
| EX-10 | | $7.0 \times 10^{-3}$ |
| HBS-1 | | 0.050 |
| Gelatin | | 0.78 |
| Thirteenth Layer (Third Blue sensitive Emulsion Layer) | | |
| Emulsion H | as silver | 0.77 |
| Sensitizing dye VII | | $2.2 \times 10^{-4}$ |
| Coupler (C-1) | | 0.20 |
| HBS-1 | | 0.070 |
| Gelatin | | 0.69 |
| Fourteenth Layer (First Protective Layer) | | |
| Emulsion I | as silver | 0.20 |
| U-4 | | 0.11 |
| U-5 | | 0.17 |
| HBS-1 | | $5.0 \times 10^{-2}$ |
| Gelatin | | 0.85 |
| Fifteenth Layer (Second Protective Layer) | | |
| H-1 | | 0.40 |
| B-1 (Diameter 1.7 μm) | | $5.0 \times 10^{-2}$ |
| B-2 (Diameter 1.7 μm) | | 0.10 |
| B-3 | | 0.10 |
| S-1 | | 0.20 |
| Gelatin | | 0.40 |

Furthermore, W-1, W-2, W-3, W-4, B-4, B-5, F-1, F-2, F-3, F-4, F-5, F-6, F-7, F8, F-9, F-10, F-11, F-12 and F-13, and iron salts, lead salts, gold salts, platinum salts, iridium salts and rhodium salts were included in all of the layers with a view to improving storage properties, processing properties, pressure resisting properties, fungicidal and biocidal properties, anti-static properties and coating properties.

| Emulsion | Average AgI Content (%) | Average Grain Size (μm) | Variation Coefficient of the Grain Size (%) | Diameter/ Thickness Ratio | Silver Weight Ratio (AgI Content %) |
|---|---|---|---|---|---|
| A | 4.0 | 0.45 | 27 | 1 | Core/Shell = 1/3 (13/1), double structure grains |
| B | 8.9 | 0.45 | 14 | 5 | Core/Shell = 3/7 (25/2), double structure grains |
| C | 10 | 0.60 | 30 | 2 | Core/Shell = 1/2 (24/3), double structure grains |
| D | 16 | 0.85 | 15 | 6 | Core/Shell = 4/6 (40/0), double structure grains |
| E | 10 | 0.85 | 20 | 7 | Core/Shell = 1/2 (24/3), double structure grains |
| F | 6.0 | 0.25 | 15 | 4 | Core/Shell = 1/3 (12/4), double structure grains |
| G | 14.0 | 0.65 | 19 | 5 | Core/Shell = 1/2 (42/0), double structure grains |
| H | 14.5 | 1.10 | 18 | 7 | Core/Shell = 37/63 (34/3), double structure grains |
| I | 1 | 0.07 | 15 | 1 | Uniform grains |

-continued
EX-1
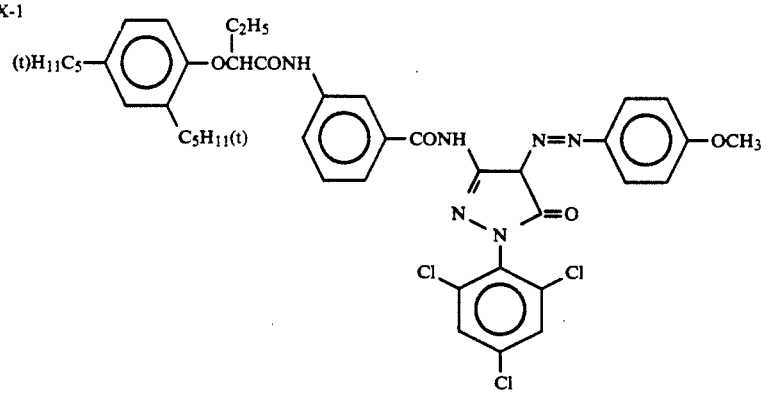
EX-2
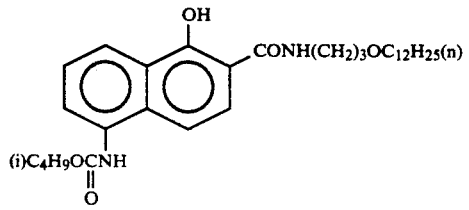
EX-3
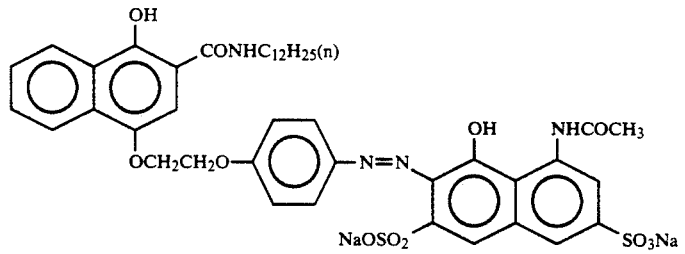
EX-4
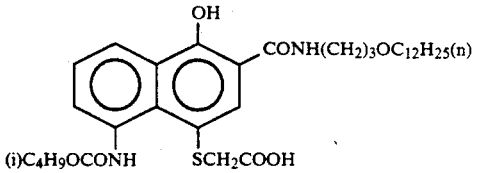
EX-5
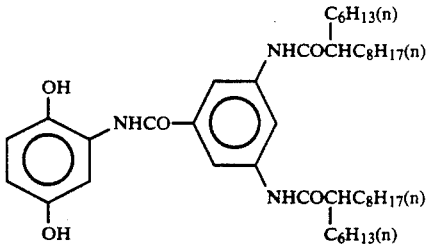
EX-6
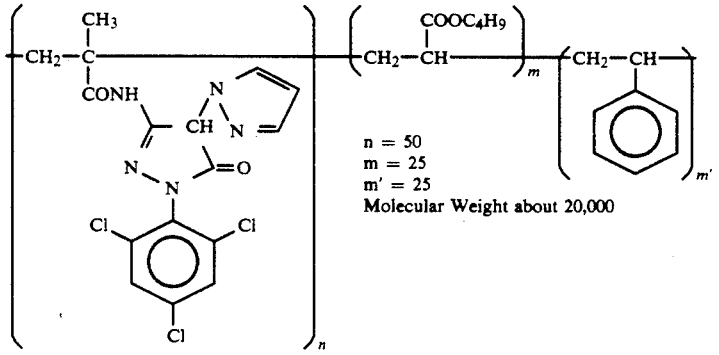
EX-7

-continued
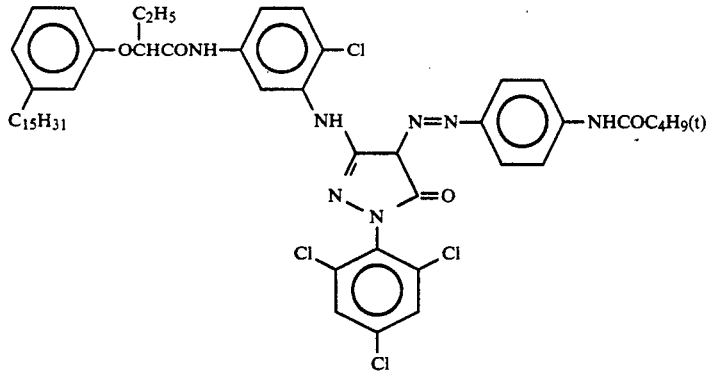
EX-8
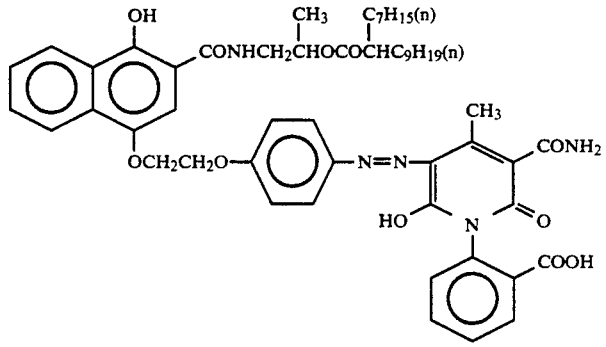
EX-9
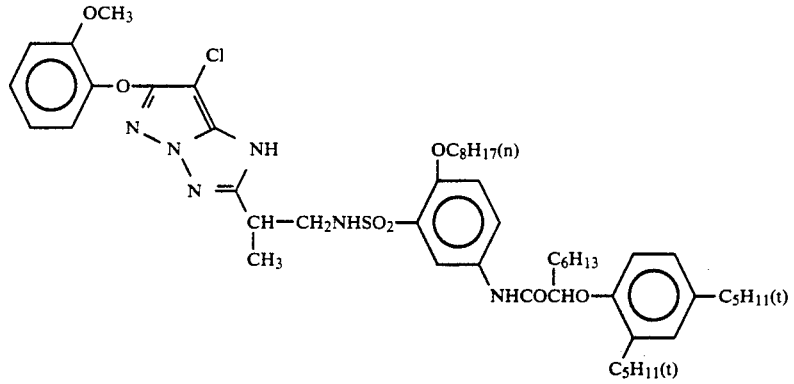
EX-10
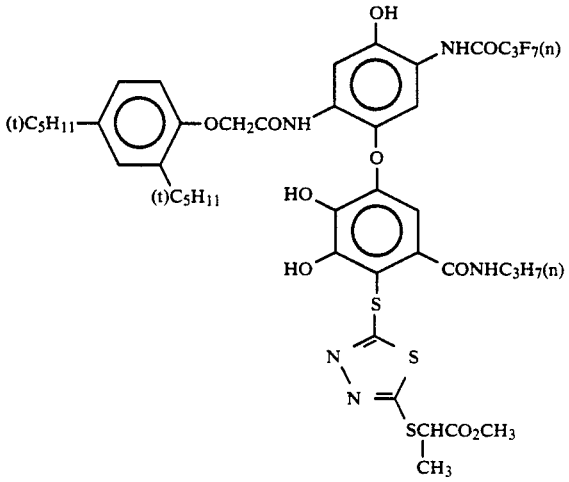
EX-11
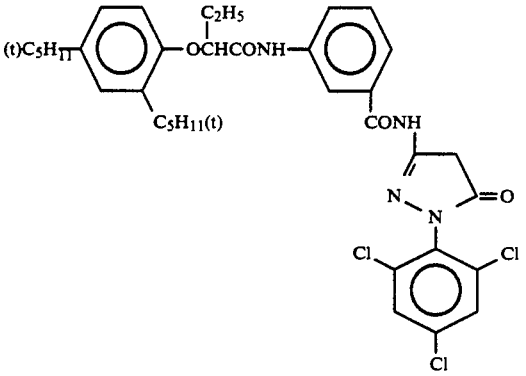

-continued
EX-12
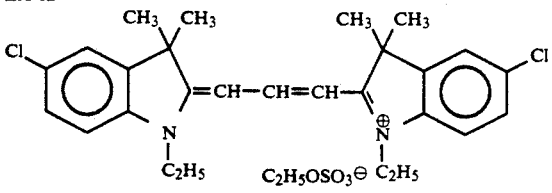
EX-13
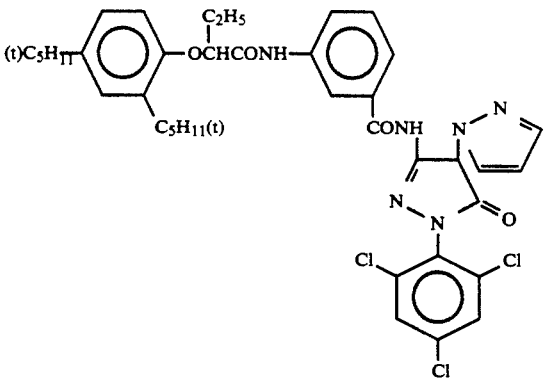
EX-14
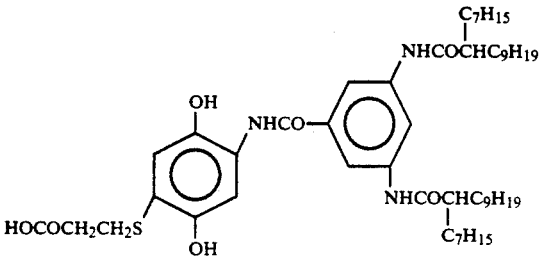
U-1
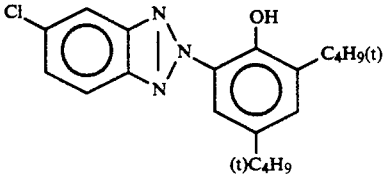
U-2
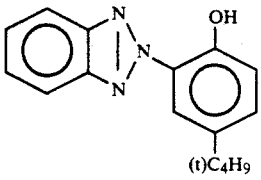
U-3
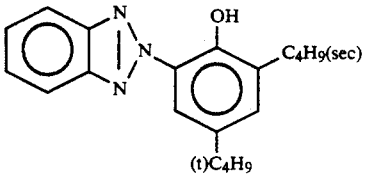
U-4
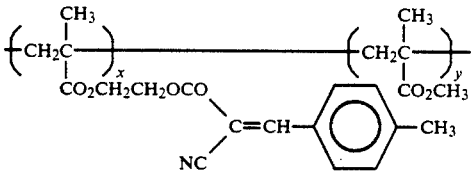
x:y = 70:30 (wt %)
U-5
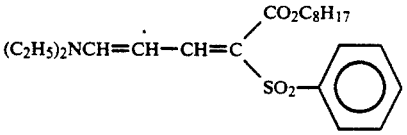
HBS-1
Tricresyl phosphate
HBS-2
Di-n-butyl phthalate
HBS-3
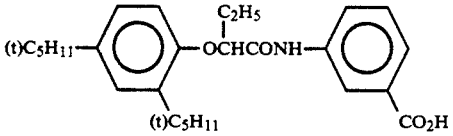
Sensitizing Dye I
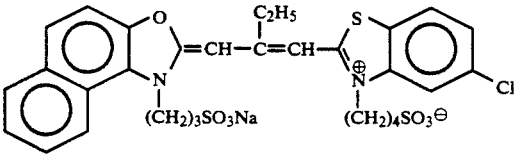
Sensitizing Dye II
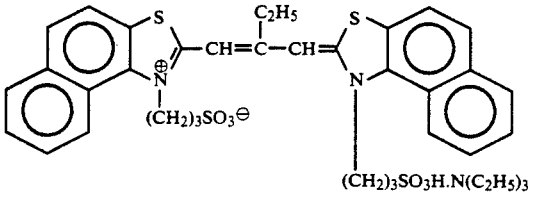
Sensitizing Dye III
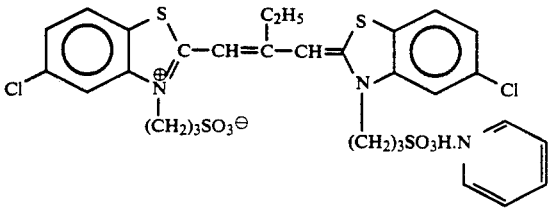
Sensitizing Dye IV
Sensitizing Dye V -continued
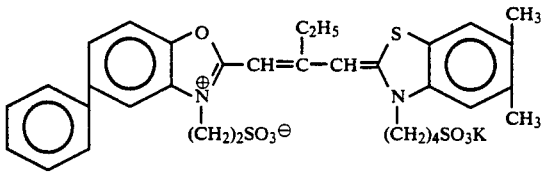
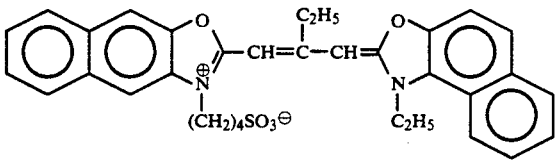
Sensitizing Dye VI
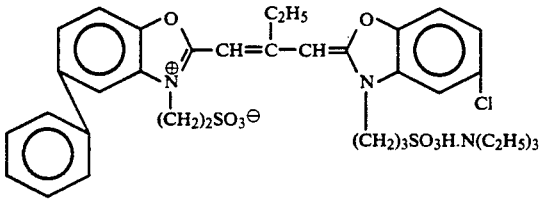
Sensitizing Dye VII
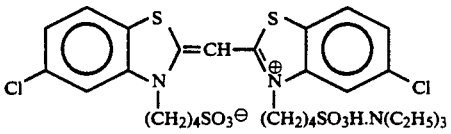
S-1
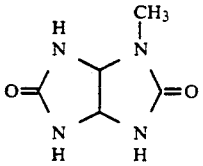
H-1
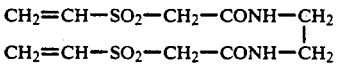
B-1
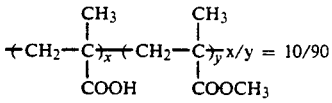
B-2
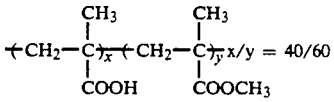
B-3
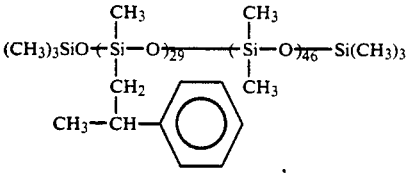
B-4
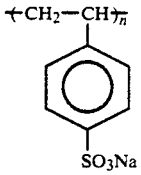
B-5
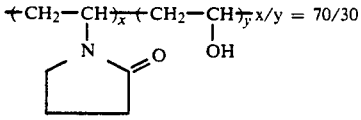
W-1
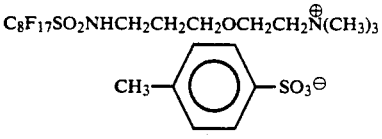
W-2
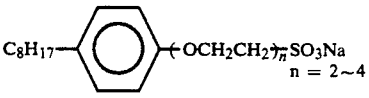
W-3
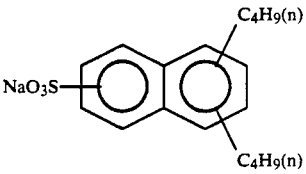
F-1
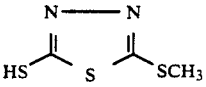
F-2
F-3

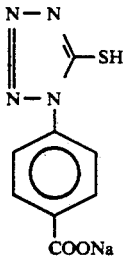

-continued

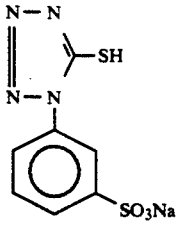

F-4

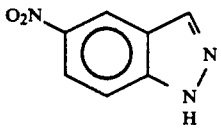

F-5

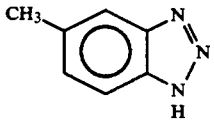

F-6

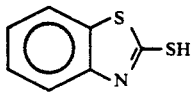

F-7

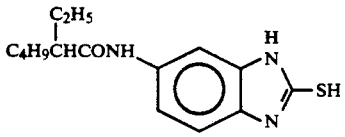

F-8

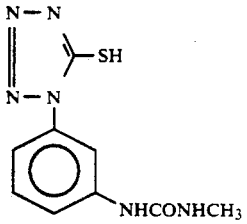

F-9

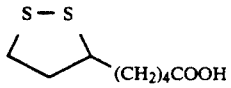

F-10

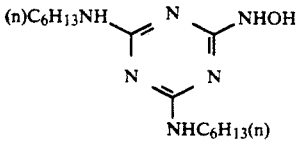

F-11

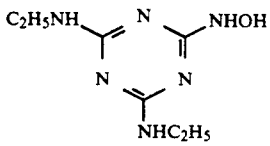

F-12

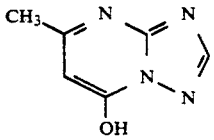

F-13

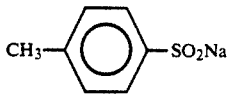

Samples 402–411

Samples 402 to 411 were prepared by replacing the coupler (C-6) in the fifth, seventh, eighth and eleventh layers of sample 401 with a comparative coupler or a coupler of the present invention in the mol ratio indicated in Table 4. The amount of coupler added was determined in such a way that the speed and gamma values after white imagewise exposure and color development processing in the way indicated below were more or less the same.

These samples were subjected to a green image-wise exposure and then color developed using the processing operations indicated below. The value obtained by subtracting the yellow fog density from the yellow density at a magenta density of (fog+1.0) was taken as the extent of color mixing and this was as shown in Table 4.

The samples were also subjected to a white light imagewise exposure and, after being processed, they were stored for 7 days at 80° C., 60% relative humidity and irradiated for 7 days from the emulsion side with fluorescent light of intensity 20,000 lux. The fall in density at an initial yellow density of 2.5 was then measured.

| Processing Operations | | | | |
|---|---|---|---|---|
| Process | Processing Time | Processing Temp. | Replenishment Rate | Tank Capacity |
| Color development | 3 min. 15 sec. | 37.8° C. | 25 ml | 10 liters |
| Bleach | 45 sec. | 38.0° C. | 5 ml | 5 liters |
| Fix (1) | 45 sec. | 38.0° C. | — | 5 liters |
| Fix (2) | 45 sec. | 38.0° C. | 30 ml | 5 liters |
| Stabilizer (1) | 20 sec. | 38.0° C. | — | 5 liters |
| Stabilizer (2) | 20 sec. | 38.0° C. | — | 5 liters |

-continued

| Process | Processing Operations: Processing Time | Processing Temp. | Replenishment Rate | Tank Capacity |
|---|---|---|---|---|
| Stabilizer (3) | 20 sec. | 38.0° C. | 40 ml | 5 liters |

Moreover, the carry-over of developer into the bleach process and the carry-over of fixer into the stabilizing process were 2.5 ml and 2.0 ml, respectively, per meter length of photosensitive material of width 35 mm.

The compositions of the processing baths were as indicated below.

| | Parent Bath (grams) | Replenisher (grams) |
|---|---|---|
| Color Development Bath | | |
| Diethylenetriamine penta-acetic acid | 5.0 | 6.0 |
| Sodium sulfite | 4.0 | 5.0 |
| Potassium carbonate | 30.0 | 37.0 |
| Potassium bromide | 1.3 | 0.5 |
| Potassium iodide | 1.2 mg | — |
| Hydroxylamine sulfate | 2.0 | 3.6 |
| 4-(N-Ethyl-N-β-hydroxyethylamino)-2-methylaniline sulfate | 4.7 | 6.2 |
| Water to make up to | 1.0 liter | 1.0 liter |
| pH | 10.00 | 10.15 |
| Bleach | | |
| 1,3-Diaminopropane tetra-acetic acid, ferric ammonium salt, mono-hydrate | 144.0 | 206.0 |
| 1,3-Diaminopropane tetra-acetic acid | 2.8 | 4.0 |
| Potassium bromide | 84.3 | 120.0 |
| Ammonium nitrate | 17.5 | 25.0 |
| Aqueous ammonia (27%) | 10.0 | 1.8 |
| Acetic acid (98%) | 51.1 | 73.0 |
| Water to make | 1.0 liter | 1.0 liter |
| pH | 4.3 | 3.4 |

| | (Grams) |
|---|---|
| Fixer-Parent Bath = Replenisher | |
| Ethylenediamine tetra-acetic acid, disodium salt | 1.7 |
| Sodium sulfite | 14.0 |
| Sodium bisulfite | 10.0 |
| Aqueous ammonium thiosulfate solution, (70% wt/vol) | 210.0 ml |
| Ammonium thiocyanate | 163.0 |
| Thiourea | 1.8 |
| Water to make | 1.0 liter |
| pH | 6.5 |
| Stabilizer-Parent bath = Replenisher | |
| Surfactant | 0.5 |

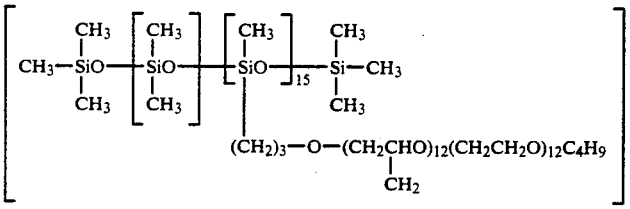

| | |
|---|---|
| Surfactant $[C_{10}H_{21}-O-(CH_2CH_2O)_{10}-H]$ | 0.4 |
| Triethanolamine | 2.0 |
| 1,2-Benzisothiazolin-3-one methanol | 0.3 |
| Formalin (37%) | 1.5 |
| Water to make | 1.0 liter |
| pH | 6.5 |

| | | |
|---|---|---|
| Drying | 1 min. | 55° C. |

Replenishment rate per square meter of width 35 mm
A counter-flow system from fix (2) to fix (1)
A counter-flow system from stabilized (3) to stabilizer (1)

| Sample | Coupler in the Fourth, Seventh, Eighth and Eleventh Layers: Type | Amount | Extent of Color Mixing | Fall in Density in Forced Heating Test | Fall in Density in Forced Light Test |
|---|---|---|---|---|---|
| 401 (Comparative Example) | C-6 | 1.0 | 0.09 | 0.21 | 0.18 |
| 402 (Comparative Example) | C-7 | 3.0 | 0.17 | 0.12 | 0.13 |
| 403 (Comparative Example) | C-8 | 1.2 | 0.19 | 0.18 | 0.14 |
| 404 (Comparative Example) | C-9 | 1.0 | 0.15 | 0.13 | 0.10 |

-continued

| Sample | Coupler in the Fourth, Seventh, Eighth and Eleventh Layers | | Extent of Color Mixing | Fall in Density in Forced Heating Test | Fall in Density in Forced Light Test |
|---|---|---|---|---|---|
| | Type | Amount | | | |
| 405 (Comparative Example) | C-10 | 1.0 | 0.11 | 0.17 | 0.14 |
| 406 (Comparative Example) | C-11 | 0.9 | 0.09 | 0.25 | 0.21 |
| 407 (This Invention) | (5) | 1.2 | 0.09 | 0.06 | 0.02 |
| 408 (This Invention) | (6) | 1.4 | 0.08 | 0.06 | 0.02 |
| 409 (This Invention) | (7) | 2.0 | 0.09 | 0.08 | 0.03 |
| 410 (This Invention) | (8) | 2.5 | 0.07 | 0.09 | 0.03 |
| 411 (This Invention) | (10) | 1.2 | 0.08 | 0.06 | 0.02 |

It is clear from Table 4 that the samples in which a coupler of the present invention had been used had excellent color reproduction as shown by the extent of color mixing, and excellent color image storage properties.

EXAMPLE 5

C-5 (comparative coupler (C-2) of the present invention) in the twelfth layer and C-7 in the thirteenth layer in JP-A-2-854 are replaced by equimolar amounts of couplers (1), (2), (4) and (18) of the present invention and, on processing in the way described in example 2 after subjecting the samples to a blue imagewise exposure, good yellow dye images which have a good yellow density and little admixture of orange are obtained.

EXAMPLE 6

Sample No. 214 (a multi-layer color paper) disclosed in example 2 of European Patent EP-0,355,660A2 is used as a silver halide color photosensitive material. However, III-10 is used instead of the III-23 disclosed in said patent as a bisphenol compound and the compounds indicated below are used for the yellow coupler (ExY), the cyan coupler (ExC), the image stabilizer (Cpd-8), the solvent (Solv-6) and the oxonol dyes. Moreover, the compounds indicated below are used as fungicides (biocides) in the preparation of sample 601.

(ExY) Yellow Coupler

A 1:1 (mol ratio) mixture of:

(ExY) Yellow Coupler
A 1:1 (mol ratio) mixture of:

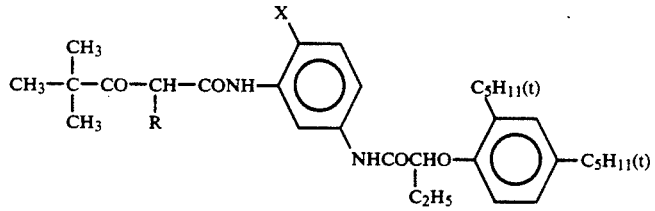

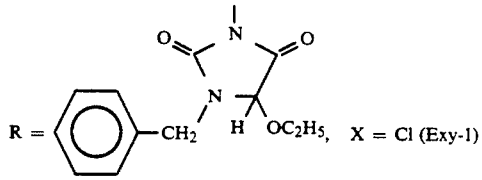

R = , X = Cl (Exy-1)

and

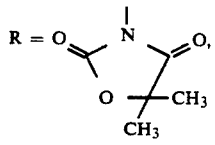

R = , X = $OCH_3$ (Exy-2)

(ExC) Cyan Coupler

A 1:1:1 (mol ratio) mixture of:

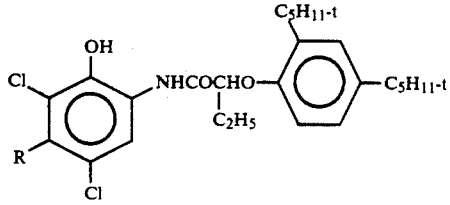

R = $CH_3$ and R = $C_2H_5$ and

-continued
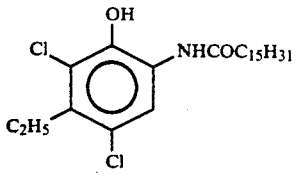
(Cpd-8) Colored Image Stabilizer
A 1:1 (mol ratio) mixture of:
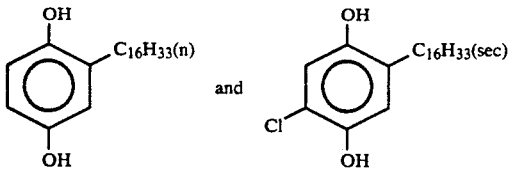
(Cpd-10) Fungicide
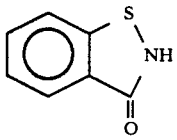
(25.0 mg/m$^2$)
(Cpd-11) Fungicide
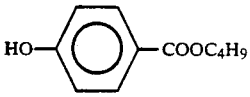
(50.0 mg/m$^2$)
(Solv-6) Solvent
A 9:1 (by weight) mixture of:
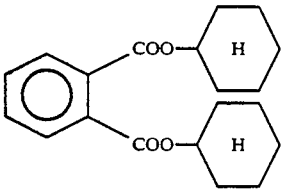
and
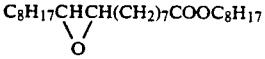
(Oxonol Dyes)
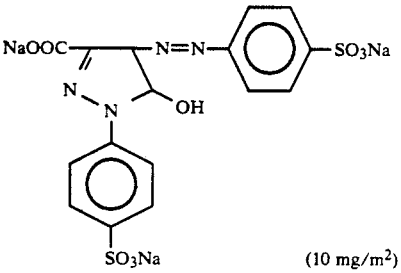
(10 mg/m$^2$)

-continued

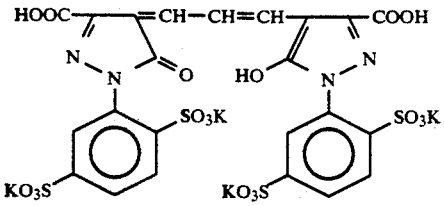

(10 mg/m²)

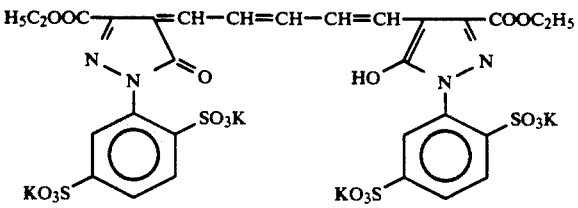

(40 mg/m²)

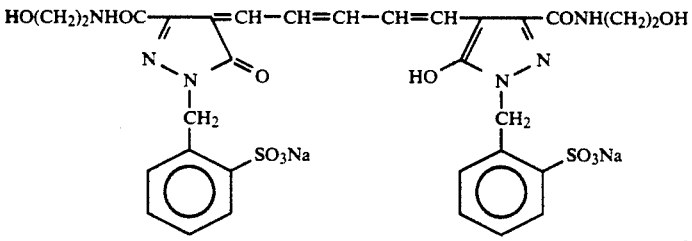

(20 mg/m²)

Samples 602 to 604 are prepared by replacing ExY-1 in sample 601 with equimolar amounts of the couplers (1), (2) and (4) of the present invention. Furthermore, samples 605 to 607 are prepared by replacing ExY-2 with couples (1), (2) and (4) of the present invention. These samples are subjected to a blue imagewise exposure and, on color development and processing using the method disclosed in example 2 of the aforementioned patent, samples 602 to 607 in which couplers of the present invention have been used provided lemon yellow color images which had a high yellow density and less long wave absorbance than sample 601.

C-1 (Compound 1, Research Disclosure No. 18053)

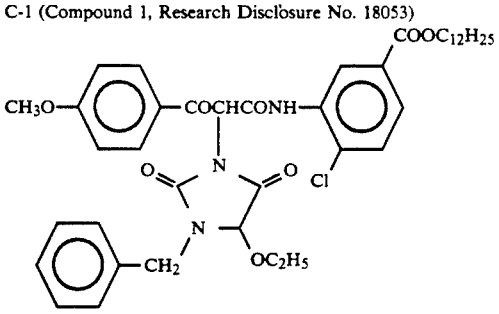

C-2 (Compound 14 of Research Disclosure No. 18053)

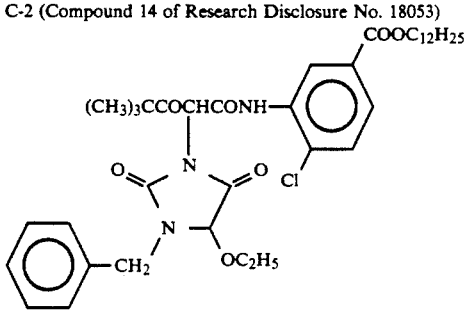

C-3 (Coupler (65) of U.S. Pat. No. 4,404,274)

-continued
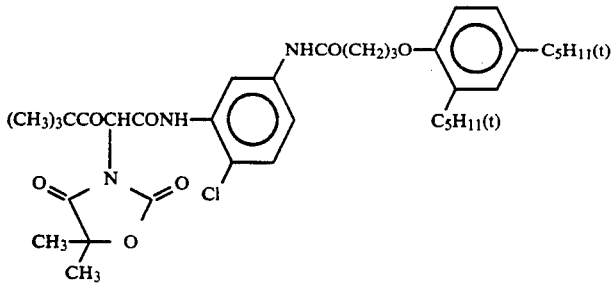
C-4 (Coupler A of U.S. Pat. No. 3,933,501)
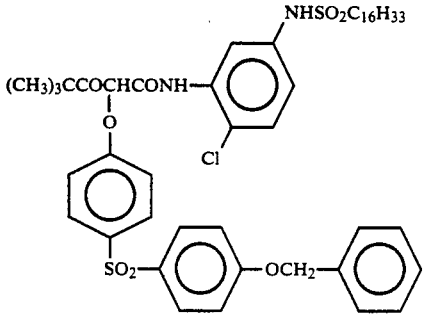
C-5 (Coupler Similar to Coupler Disclosed in U.S. Pat. No. 4,149,886)
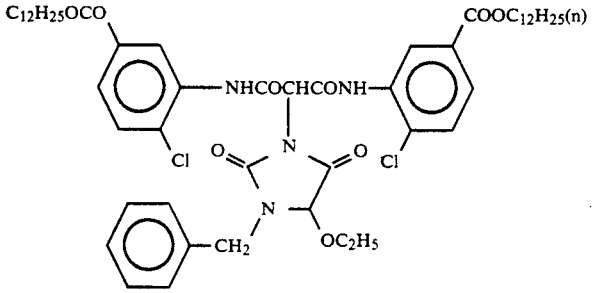
C-6 (Coupler (16) disclosed in U.S. Pat. No. 4,477,563)
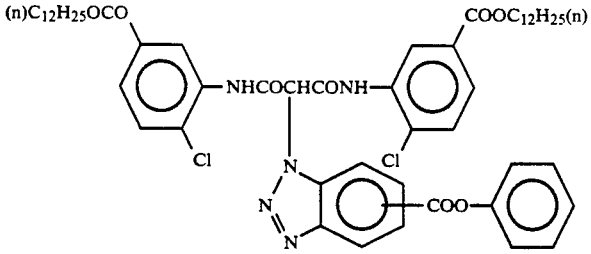
C-7 (Coupler similar to the couplers disclosed in U.S. Pat. No. 4,149,886 and British Patent 1,204,680)
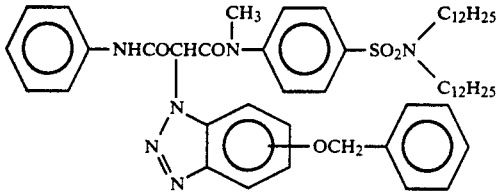
C-8 (Coupler Similar to Coupler (40) of U.S. Pat. No. 3,632,345)

-continued

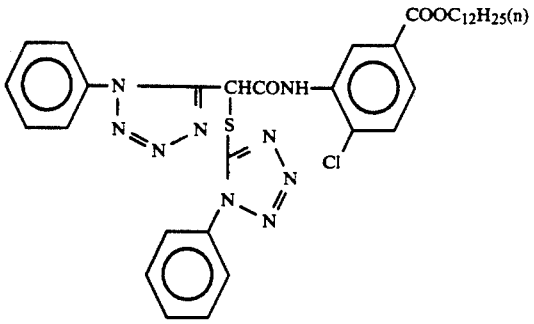

C-9 (Coupler of JP-A-63-261262)

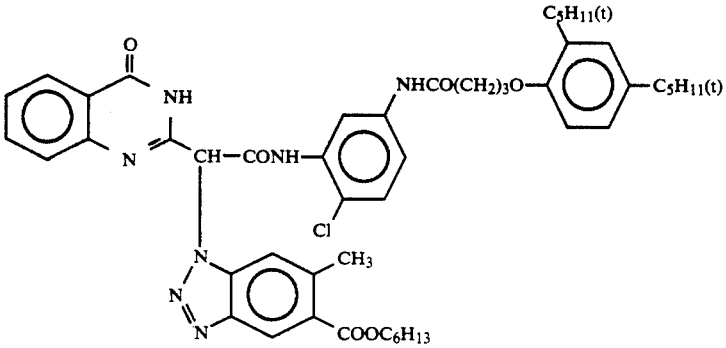

C-10 (Coupler of JP-A-2-28645)

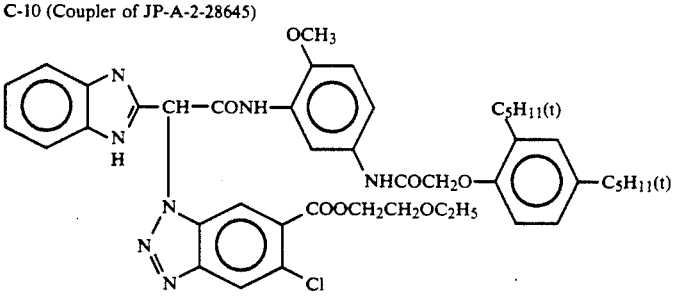

C-11 (Coupler of JP-A-2-2552)

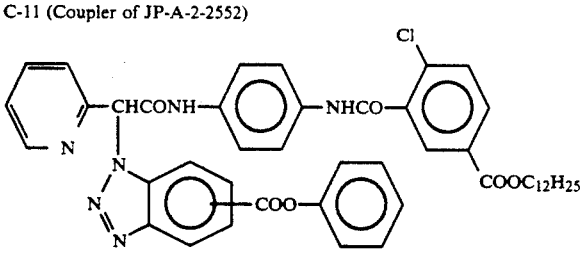

EFFECT OF THE INVENTION

The yellow couplers of the present invention form images which have excellent color reproduction and image fastness. In terms of color reproduction they are effective in that in the spectral absorbance of the dyes the tail on the long wave length side in particular is short. In terms of image fastness, the images can be stored for long periods with respect to both (i) heat and humidity, and (ii) light.

Furthermore, since the reactivity of the couplers with the oxidized form of a developing agent is high they provide high maximum color densities as a characteristic feature. Consequently, it is possible to reduce the amount of coupler required to provide a given density and so the film thickness of the emulsion layer can be reduced.

The distinguishing feature of the couplers of the present invention is that one malondiamide is a secondary amino group. It is thought that it is because of this that the good spectral absorption of the dye and the improved image fastness are achieved.

While the invention has been described in detail and with reference to specific embodiments thereof, it will be apparent to one skilled in the art that various changes and modifications can be made therein without departing from the spirit and scope thereof.

While the invention has been described in detail and with reference to specific embodiments thereof, it will be apparent to one skilled in the art that various changes and modifications can be made therein without departing from the spirit and scope thereof.

What is claimed is:

1. A silver halide color photographic photosensitive material which contains a coupler represented by formula (1):

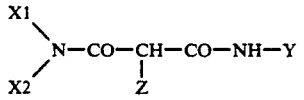

Formula (1)

wherein X1 and X2 each represent an alkyl group or a heterocyclic group, Y represents an aryl group or a heterocyclic group, and Z represents a group which is eliminated when the coupler which is represented by formula (1) reacts with an oxidized form of a developing agent.

2. The silver halide color photographic photosensitive material of claim 1, wherein the alkyl groups of X1 and X2 are linear chain, branched or cyclic, substituted or unsubstituted alkyl groups which have from 1 to 30 carbon atoms.

3. The silver halide color photographic photosensitive material of claim 1, wherein X1 and X2 are substituted alkyl groups and the substituents are selected from the group consisting of alkoxy groups, halogen atoms, alkoxycarbonyl groups, acyloxy groups, sulfonyl groups, carbamoyl groups, sulfamoyl groups and aryl groups.

4. The silver halide color photographic photosensitive material of claim 1, wherein X1, X2 and Y represent heterocyclic groups having three to twelve membered, saturated or unsaturated, substituted or unsubstituted, single ring or condensed ring heterocyclic groups which have from 1 to 20 carbon atoms and which contain at least one nitrogen atom, oxygen atom or sulfur atom as a hetero atom.

5. The silver halide color photographic photosensitive material of claim 1, wherein Y represents an aryl group which is substituted or unsubstituted and has from 6 to 20 carbon atoms.

6. The silver halide color photographic photosensitive material of claim 1, wherein Xl is an alkyl group having from 1 to 10 carbon atoms.

7. The silver halide color photographic photosensitive material of claim 1, wherein Y is a phenyl group having at least one substituent group in the ortho position.

8. The silver halide color photographic photosensitive material of claim 1, wherein Z is a five or six membered nitrogen containing heterocyclic gorup which is bonded to the coupling position by a nitrogen atom, an aromatic oxy group, a five or six membered heterocyclic oxy group or a five or six membered heterocyclic thio group.

9. The silver halide color photographic photosensitive material of claim 1, wherein the coupler of formula (1) is represented by formula (2):

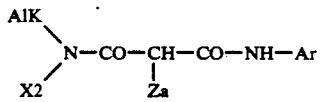

Formula (2)

wherein X2 has the same meaning as that described in formula (1), Alk represents an alkyl group having from 1 to 10 carbon atoms, Ar represents a phenyl group which has at least one substituent group in an ortho position and Za represents a five or six membered nitrogen containing heterocyclic group which is bonded to the coupling position with a nitrogen atom, an aromatic oxy group or a five or six membered heterocyclic thio group.

10. The silver halide color photographic photosensitive material of claim 1, wherein the coupler of formula (1) is added to a photosensitive silver halide emulsion layer or to a layer adjacent thereto.

11. The silver halide color photographic photosensitive material of claim 1, wherein the coupler of formula (1) is present in an amount of 0.0001 to 0.80 g/m$^2$ when a photographically useful component is included in leaving group Z and when there is no photographically useful group component in leaving group Z the amount of the coupler of formula (1) is 0.001 to 1.20 g/m$^2$.

12. The silver halide color photographic photosensitive material of claim 1, wherein said coupler of formula (1) is fast to diffusion.

13. The silver halide color photographic photosensitive material of claim 9, wherein said coupler of formula (1) is fast to diffusion.

* * * * *